US005604072A

United States Patent [19]

Unno et al.

[11] Patent Number: 5,604,072

[45] Date of Patent: Feb. 18, 1997

[54] TONER FOR DEVELOPING ELECTROSTATIC IMAGES, IMAGE FORMING METHOD AND PROCESS CARTRIDGE

[75] Inventors: Makoto Unno, Tokyo; Takaaki Kotaki, Yokohama; Yushi Mikuriya; Tadashi Dojyo, both of Kawasaki, all of Japan

[73] Assignee: Canon Kabushiki Kaisha, Tokyo, Japan

[21] Appl. No.: 530,057

[22] Filed: Sep. 19, 1995

[30] Foreign Application Priority Data

Sep. 21, 1994 [JP] Japan ..... 6-251574

[51] Int. Cl.[6] ..... G03G 9/107

[52] U.S. Cl. ..... 430/110; 430/126; 399/120

[58] Field of Search ..... 430/106, 109, 430/110, 126; 355/260

[56] References Cited

U.S. PATENT DOCUMENTS

| | | | |
|---|---|---|---|
| 2,221,776 | 11/1940 | Carlson | 95/5 |
| 2,297,691 | 10/1942 | Carlson | 95/5 |
| 2,618,552 | 11/1952 | Wise | 95/1.9 |
| 2,874,063 | 2/1959 | Greig | 117/17.5 |
| 2,892,858 | 6/1959 | Ziegler | 260/448 |
| 3,666,363 | 5/1972 | Tanaka et al. | 355/17 |
| 4,071,361 | 1/1978 | Marushima | 96/1.4 |
| 4,533,614 | 8/1985 | Fukumoto et al. | 430/109 |
| 5,344,737 | 9/1994 | Berkes et al. | 430/110 |
| 5,439,770 | 8/1995 | Taga et al. | 430/106 |

FOREIGN PATENT DOCUMENTS

| | | | |
|---|---|---|---|
| 0276147 | 7/1988 | European Pat. Off. | G03G 9/08 |
| 0417812 | 3/1991 | European Pat. Off. | G03G 9/08 |
| 0606873 | 7/1994 | European Pat. Off. . | |
| 42-23910 | 11/1967 | Japan . | |
| 43-24748 | 10/1968 | Japan . | |
| 50-81342 | 7/1975 | Japan . | |
| 56-91243 | 7/1981 | Japan . | |
| 56-144436 | 11/1981 | Japan . | |
| 58-11953 | 1/1983 | Japan . | |
| 60-184260 | 9/1985 | Japan . | |
| 61-59350 | 3/1986 | Japan . | |

OTHER PUBLICATIONS

Patent Abstract of Japan, vol. 14, No. 392 (P–1096)[4335] (1990) based on JP2–148045.

2244 Research Disclosure No. 311, Mar. 1990, entitled "Toner Charge Control Additive" by Petrolite Corporation, p. 280, XP 104554.

*Primary Examiner*—John Goodrow

*Attorney, Agent, or Firm*—Fitzpatrick, Cella, Harper & Scinto

[57] ABSTRACT

A toner for developing electrostatic images comprises, (i) a binder resin, (ii) a colorant, and (iii) a compound made by a reaction of a monohydroxylic compound having a long-chain alkyl group having an alkylene group with 40 or more carbon atoms and a hydroxyl group with a carboxylic acid having a molecular weight of 1,000 or less, or a compound made by a reaction of a monocarboxylic compound having a long-chain alkyl group having an alkylene group with 40 or more carbon atoms and a carboxyl group with an alcohol having a molecular weight of 1,000 or less.

41 Claims, 1 Drawing Sheet

TONER FOR DEVELOPING ELECTROSTATIC IMAGES, IMAGE FORMING METHOD AND PROCESS CARTRIDGE

BACKGROUND OF THE INVENTION

1. Field of the Invention

This invention relates to a toner used in electrophotography, electrostatic recording or the like. More particularly, it relates to a magnetic toner with insulating properties, an image forming method making use of such a magnetic toner, and a process cartridge detachable from the body of an image forming apparatus having the magnetic toner.

2. Related Background Art

A number of methods are hitherto known for electrophotography, as disclosed in U.S. Pat. No. 2,297,691, Japanese Patent Publications No. 42-23910 (U.S. Pat. No. 3,666,363) and No. 43-24748 (U.S. Pat. No. 4,071,361) and so forth. In general, copies or prints are obtained by forming an electrical latent images on a photosensitive member by utilizing a photoconductive material and by various means, subsequently developing the latent images by the use of a toner to form visible images (toner images), and transferring the toner images to a transfer medium such as paper if necessary, followed by fixing by the action of heat or pressure or both of them.

Various developing methods by which electrostatic latent images are formed into visible images by the use of a toner are also known. For example, they include a number of developing methods such as the magnetic brush development as disclosed in U.S. Pat. No. 2,874,063, the cascade development as disclosed in U.S. Pat. No. 2,618,552, the powder cloud development as disclosed in U.S. Pat. No. 2,221,776, the fur brush development and the liquid development.

In these developing methods, the magnetic brush development, the cascade development and the liquid development, which employ two-component developers mainly composed of a toner and a carrier, are particularly put into practical use. These methods are all superior methods which can relatively stably given good images, but on the other hand they have common disadvantages involved in the two-component developer, which are such that the carrier may deteriorate and the mixing ratio between the toner and the carrier may vary.

To eliminate such disadvantages, developing methods employing one-component developers comprised of a toner only are proposed in variety. In particular, many superior methods are seen in methods employing developers comprising toner particles having magnetic properties.

Various methods or devices have been developed in relation to the step of fixing toner images to a sheet such as paper, which is a final step in the above electrophotographic process. A method most commonly available at present is a pressure heat system using a heat roller.

The pressure heat system using a heat roller is a method of carrying out fixing by causing a toner image side of an image-receiving sheet to pass the surface of a heat roller whose surface has releasability to toner while the former is brought into contact with the latter under pressure.

Since in this method the surface of the heat roller comes into contact with the toner image of the image-receiving sheet under pressure, a very good thermal efficiency can be achieved when the toner image is fixed onto the image-receiving sheet, so that the fixing can be carried out rapidly. Thus, this method is very effective in a high-speed electrophotographic copying machines.

Especially in the future, copying machines will be designed for higher-speed copying, hence toners to be used should be improved in their fixing performance on recording mediums such as paper, and satisfy good image density and high operational performance (good durability) in high-speed development.

In such a heat roller fixing method, polyolefin wax is conventionally added in toner so that its anti-offset properties can be improved.

Since polyolefin wax, however, does not have good compatibility with binder resin in toner, faulty dispersion of polyolefin wax may occur when the toner is produced, causing free polyolefin at the time of pulverization.

The faulty dispersion of polyolefin wax in the toner results in not only faulty cleaning and deterioration of anti-offset properties during operation of a copying machine, but also an increase in non-uniformity of toner chargeability to cause a decrease in image density during the operation.

Japanese Patent Application Laid-open Nos. 50-81342, 56-144436, 58-11953 and 60-184260 disclose toners employing a fatty acid ester or a wax having an ester component.

In the technique disclosed in these, the ester component is not a fatty acid ester not having a long-chain alkyl group. Hence, when applied in high-speed development carried out at a process speed of 380 mm/sec or higher, improvement in fixing performance and anti-offset properties can not be said to be satisfactory. Especially when applied in a toner having an average particle diameter smaller than 10 μm, the faulty dispersion of wax in binder resin may occur to cause non-uniform toner chargeability due to charge-up in an environment of low humidity, so that image density may be reduced during operation.

Especially in the future, the particle diameter of toners will be made smaller, and hence the dispersibility of wax components is sought to be more improved.

As the particle diameter of toner becomes smaller, the charge-up may come into question especially in an environment of low humidity, which is accompanied by an unavoidable problem of decrease in image density.

EP-A-0606873 discloses a toner containing as a binder resin a polyester resin at least part of which has been modified with a compound having i) a long-chain alkyl group having 22 to 102 carbon atoms and ii) a hydroxyl group or carboxyl group at its terminal. This compound, however, is obtained by reaction on a resin which has such a large molecular weight as the polyester resin, and therefore, EP-A-0606873 is directed to an invention having a concept different from the present invention.

SUMMARY OF THE INVENTION

An object of the present invention is to provide a toner that can solve the problems discussed above, an image forming method making use of such a toner, and a process cartridge having the toner.

An object of the present invention is to provide a toner that can achieve good fixing performance and anti-offset properties also in high-speed copying machines, an image forming method making use of such a toner, and a process cartridge having the toner.

An object of the present invention is to provide a toner wherein the quantity of triboelectricity due to the friction between toner particles and between toner and a toner carrying member such as a developing sleeve is stable and can be controlled to the charge quantity suited for developing systems used, an image forming method making use of such a toner, and a process cartridge having the toner.

An object of the present invention is to provide a toner that can increase the density difference between dots which enables development faithful to digital latent images and can sharply reproduce dot edges, an image forming method making use of such a toner, and a process cartridge having the toner.

An object of the present invention is to provide a toner that can maintain initial performance even when the toner is continuously used over a long period of time, an image forming method making use of such a toner, and a process cartridge having the toner.

An object of the present invention is to provide a toner that may cause less fog and reversal fog even in image forming processes having the step of post charging, an image forming method making use of such a toner, and a process cartridge having the toner.

An object of the present invention is to provide a toner that can reproduce stable images not affected by variations of temperature and humidity, an image forming method making use of such a toner, and a process cartridge having the toner.

An object of the present invention is to provide a toner that can promise a good storage stability sufficient to maintain initial properties even when store for a long period of time, an image forming method making use of such a toner, and a process cartridge having the toner.

An object of the present invention is to provide a toner that can prevent charge-up, which is a problem raised when the toner is made to have small particle diameters, and can impart good image density, an image forming method making use of such a toner, and a process cartridge having the toner.

The present invention provides a toner for developing electrostatic images, comprising;

(i) a binder resin;

(ii) a colorant; and (iii) a compound obtained by allowing a monohydroxylic compound having a long-chain alkyl group having an alkylene group with 40 or more carbon atoms and a hydroxyl group to react with a carboxylic acid having a molecular weight of 1,000 or less, or a compound obtained by allowing a monocarboxylic compound having a long-chain alkyl group having an alkylene group with 40 or more carbon atoms and a carboxyl group to react with an alcohol having a molecular weight of 1,000 or less.

The present invention also provides an image forming method comprising;

forming an electrostatic latent image on an electrostatic latent image bearing member;

developing the electrostatic latent image through a developing means in a developing zone to form a toner image on the electrostatic latent image bearing member; wherein the developing means holds a toner, the toner comprising;

(i) a binder resin;

(ii) a colorant; and (iii) a compound obtained by allowing a monohydroxylic compound having a long-chain alkyl group having an alkylene group with 40 or more carbon atoms and a hydroxyl group to react with a carboxylic acid having a molecular weight of 1,000 or less, or a compound obtained by allowing a monocarboxylic compound having a long-chain alkyl group having an alkylene group with 40 or more carbon atoms and a carboxyl group to react with an alcohol having a molecular weight of 1,000 or less;

transferring the toner image to a recording medium; and fixing the transferred toner image to the recording medium.

The present invention still also provides a process cartridge which is detachable from the body of an image forming apparatus, comprising;

an electrostatic latent image bearing member and a developing means; wherein the developing means holds a toner, the toner comprising;

(i) a binder resin;

(ii) a colorant; and (iii) a compound obtained by allowing a monohydroxylic compound having a long-chain alkyl group having an alkylene group with 40 or more carbon atoms and a hydroxyl group to react with a carboxylic acid having a molecular weight of 1,000 or less, or a compound obtained by allowing a monocarboxylic compound having a long-chain alkyl group having an alkylene group with 40 or more carbon atoms and a carboxyl group to react with an alcohol having a molecular weight of 1,000 or less.

DESCRIPTION OF THE PREFERRED EMBODIMENTS

Figure 1:
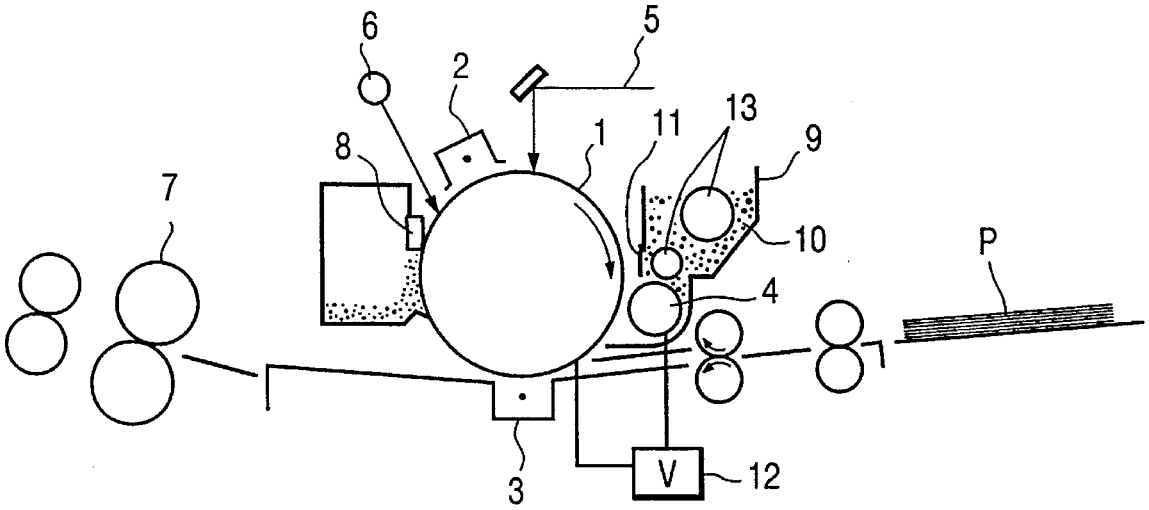
FIG. 1 schematically illustrates an image forming apparatus to describe the image forming method of the present invention.

In the present invention, the toner comprises a compound obtained by allowing a monohydroxylic compound having a long-chain alkyl group having an alkylene group with 40 or more carbon atoms and a hydroxyl group to react with a carboxylic acid having a molecular weight of 1,000 or less (hereinafter "ester compound β"), or a compound obtained by allowing a monocarboxylic compound having a long-chain alkyl group having an alkylene group with 40 or more carbon atoms and a carboxyl group to react with an alcohol having a molecular weight of 1,000 or less (hereinafter "ester compound β"). More specifically, both of the ester compounds α and β have in its structure a long-chain alkyl group having an alkylene group with 40 or more carbon atoms, and a residual group of a hydroxyl group or carboxyl group of an alcohol or carboxylic acid having a molecular weight of 1,000 or less.

The toner constitution of the present invention makes it possible to provide a good fixing performance in an environment of low temperature and a good image density in an environment of low humidity even in high-speed copying machines having a process speed of 380 mm/sec or higher (high-speed copying machine having an A4 copying speed of 60 sheets per minute).

In the present invention, the ester compounds α and β can control viscosity and plasticity by virtue of the carboxylic acid or alcohol with which the monohydroxylic compound or monocarboxylic compound is reacted.

In the present invention, the alkylene group of the monohydroxylic compound or monocarboxylic compound may have 40 or more carbon atoms, preferably 40 to 200 carbon atoms, and more preferably 50 to 150 carbon atoms, in view of the viscosity control of toner and the fixing performance of the toner to paper. If this alkylene group has less than 40 carbon atoms, the viscosity control tends to be insufficient, and on the other hand if it has too many carbon atoms, the dispersibility of the ester compound α or β in the binder resin may become poor and a problem may arise in the developing performance required for the toner.

In the present invention, the alkylene group of the monohydroxylic compound or monocarboxylic compound may include a methylene chain and an ethylene chain. In particular, the ethylene chain is preferred in view of the viscosity and plasticity control attributable to the ester compound α or β.

In the present invention, the monohydroxylic compound may have, in its molecular weight distribution as measured by GPC (gel permeation chromatography), a number average molecular weight Mn of 592 or more, and preferably from 592 to 2,832, and the monocarboxylic compound may have, in its molecular weight distribution as measured by GPC, a number average molecular weight Mn of 620 or more, and preferably from 620 to 2,860.

In either case where the monohydroxylic compound has Mn less than 592 or the monocarboxylic compound has Mn less than 620, the viscosity control tends to be insufficient, and on the other hand if it has too large value of Mn, the dispersibility of the ester compound α or β in the binder resin may become poor and a problem may arise in the developing performance required for the toner.

In the present invention, the ester compounds α and β may preferably have, in their molecular weight distribution as measured by GPC, a number average molecular weight (Mn) of 1,550 or more, more preferably from 1,550 to 7,000, and particularly from 1,575 to 6,000, and a weight average molecular weight (Mw) of 1,550 or more, more preferably from 1,550 to 7,000, and particularly from 1,575 to 6,000. In the present invention, when the ester compounds α and β have a number average molecular weight (Mn) of 1,550 or more and a weight average molecular weight (Mw) of 1,550 or more, the difference in viscosity between the binder resin and the ester compound α or β at the time of heat melting can be decreased.

The decrease in the viscosity difference between the binder resin and the ester compound α or β brings about a more uniform shear force acting on the binder resin and the ester compound α or β, and makes it possible to improve the dispersibility of the ester compound α or β into the binder resin even when the binder resin and the ester compound α or β have no good compatibility with each other.

As the result, it is possible to prevent poor dispersion of the ester compound α or β as a wax component in the binder resin, and, also in the case of toners having small particle diameters, in particular, toners having particle diameters smaller than 10 μm, it is possible to prevent;

1) the decrease in image density due to the charge-up in an environment of low humidity, caused by non-uniform toner chargeability; and
2) the occurrence of faulty cleaning; which are caused by the poor dispersion of the ester compound α or β in the binder resin.

Thus, if the ester compound α or β has a number average molecular weight (Mn) less than 1,550 and a weight average molecular weight (Mw) less than 1,550, the toner tends to cause the decrease in image density due to the charge-up in an environment of low humidity and also can not be said to have satisfactory fixing performance and anti-offset properties, when it is applied in the toners having particle diameters smaller than 10 μm and images are formed using the high-speed copying machines having a process speed of 380 mm/sec or higher.

In the present invention, it is not clear why the above operation (which enables the achievement of the good fixing performance in an environment of low temperature and the good image density in an environment of low humidity even when the high-speed copying machines having a process speed of 380 mm/sec or higher are used) is obtained. It is presumed to be due to the following phenomena. That is, when the toner on a recording medium such as paper to which the ester compound α or β has been added is passed through a fixing roller and heated by the fixing roller, the ester compound α or β exudes to the toner surface even at lower temperatures.

When this occurs;

1) the rublicity of the toner to the fixing roller is improved and the toner on unfixed images comes to preferentially adhere to not the fixing roller but the recording medium; and
2) the ester compound α or β comes to cover the toner surface in a semi-molten state or molten state when the ester compound α or β comes to the toner surface upon heating by the fixing roller, so that the heat conduction from the fixing roller to the toner is improved. On account of these phenomena, it is presumed that the fixing performance and anti-offset properties of the toner are improved.

In the present invention, the use of the ester compound α or β also brings about a good image density in an environment of low humidity. The reason for this is unclear, but it is presumed to be due to the following.

Since the ester compound α or β enables control of viscosity and plasticity, the dispersibility of the ester compound α or β in the binder resin can be improved, so that the chargeability and environmental stability of the toner are improved, the toner can be prevented from its charge-up in an environment of low humidity and a good image density can be obtained also in the environment of low humidity.

In the present invention, the ester compound α or β contained in the toner may preferably be in a content of from 1 to 20 parts by weight, more preferably from 2 to 15 parts by weight.

If the ester compound α or β is in a content less than 1 part by weight, it may be difficult for the toner to be effective for improving the fixing performance. If it is in a content more than 20 parts by weight, its dispersibility in the binder resin may become poor to cause sometimes a problem on the developing performance required for the toner.

In the present invention, there are no particular limitations on the manner of allowing the monohydroxylic compound to react with the carboxylic acid or on the manner of allowing the monocarboxylic compound to react with the alcohol. As an example thereof, they may be reacted in the presence of a catalyst such as monobutyltin oxide, dibutyltin oxide, antimony trioxide, tetrabutoxytitanate, zinc acetate or magnesium acetate.

In the present invention, the saturated aliphatic, monohydroxylic compound having a long-chain alkyl group having an alkylene group with 40 or more carbon atoms and a hydroxyl group may specifically include compounds represented by the following Formulas (I) to (IV).

Formula (I): $CH_3(CH_2CH_2)_lOH$ ($l \geqq 20$)

Formula (II): $CH_3(CH_2CH_2)_mCH(OH)-R$ ($m \geqq 20$; R: an alkyl group having 1 to 20 carbon atoms or H)

Formula (III): $CH_3(CH_2)_nOH$ ($n \geqq 40$)

Formula (IV): $CH_3(CH_2)_oCH(OH)-R'$ ($o \geqq 40$; R': an alkyl group having 1 to 20 carbon atoms or H)

As an example of the compound represented by the above Formula (I), there may be named a wax alcohol produced by the process disclosed in U.S. Pat. No. 2,892,858. The wax alcohol is produced through the steps of formation of triethyl aluminum and its polymerization, oxidation and hydrolysis. The production process thereof is shown below.

Formation of triethylaluminum:

$$2Al + 3H_2 + 4Al(C_2H_5)_3 \longrightarrow 6Al(C_2H_5)_2H$$

$$Al(C_2H_5)_2H + C_2H_6 \longrightarrow Al(C_2H_5)_3 + H_2$$

Polymerization:

$$Al(C_2H_5)_3 + nC_2H_4 \longrightarrow Al(R_1)(R_2)(R_3) \quad \text{(alkylalluminum)}$$

Oxidation:

$$2Al(R_1)(R_2)(R_3) + 3O_2 \longrightarrow 2Al(OR_1)(OR_2)(OR_3) \quad \text{(aluminum alkoxide)}$$

Hydrolysis:

$$Al(OR_1)(OR_2)(OR_3) \longrightarrow R_1OH + R_2OH + R_3OH$$

The wax alcohol obtained by this process may be used in the present invention.

In the present invention, as an example of the saturated aliphatic monohydroxylic compound, there may be also named UNILINE (trademark; available from Petrolite Corporation).

In the present invention, the monohydroxylic compound having a long-chain alkyl group having an alkylene group with 40 or more carbon atoms and a hydroxyl group includes a reaction product of a long-chain alkyl alcohol with a compound having one epoxy group in the molecule. It may specifically include a compound obtained by allowing an alkyl alcohol represented by the following Formula (V);

Formula (V): $CH_3(CH_2)_nOH$ ($n \geqq 40$)

to react with a compound represented by the following Formula (VI);

Formula (VI):

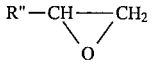

wherein R" represents a hydrogen atom, a hydrocarbon group having 1 to 20 carbon atoms or a group represented by the formula: $R_4$—$CH_2$—, where $R_4$ represents an ether group or an ester group;

to yield a reaction product represented by the following Formula (VII).

Formula (VII):

$$CH_3(CH_2)_n-O-\left[CH(R'')-CH_2-O\right]_p-H$$

wherein n represents a number of 40 or more; p represents a number of 1 to 10; and R" represents a hydrogen atom, a hydrocarbon group having 1 to 20 carbon atoms or a group represented by the formula: $R_4$—$CH_2$—, where $R_4$ represents an ether group or an ester group.

The reaction product represented by Formula (VII) is superior in view of the improvement in the fixing performance of the toner to paper. In view of the viscosity control, the compounds represented by Formula (I) to (IV) are more preferable than the reaction product represented by Formula (VII).

Examples of the compound of Formula (VI) wherein R" is hydrogen are shown below.

Ethylene oxide

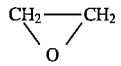

Examples of the compound of Formula (VI) wherein R" is a hydrocarbon group having 1 to 20 carbon atoms are shown below.

Propylene oxide

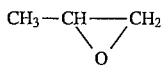

Styrene oxide

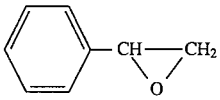

Examples of the compound of Formula (VI) wherein R" is a group represented by the formula: $R_4$—$CH_2$—, where $R_4$ represents an ether group or an ester group, are shown below.

Allylglycidyl ether

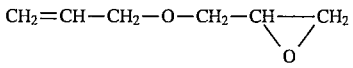

Phenylglycidyl ether

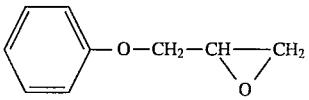

n-Butylglycidyl ether

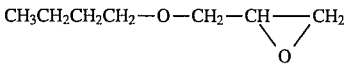

Glycidyl esters

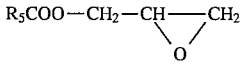

($R_5$ represents a hydrocarbon group)

In the present invention, the saturated monocarboxylic compound having a long-chain alkyl group having an alkylene group with 40 or more carbon atoms and a carboxyl group may specifically include compounds represented by the following Formulas (VIII) to (XI).

Formula (VIII): $CH_3(CH_2CH_2)_qCOOH$ ($q \geqq 20$)

Formula (IX): $CH_3(CH_2CH_2)_rCH(COOH)-R'''$ ($r \geqq 20$; R''': an alkyl group having 1 to 20 carbon atoms or H)

Formula (X): $CH_3(CH_2)_nCOOH$ ($s \geqq 40$)

Formula (XI): $CH_3(CH_2)_tCH(COOH)-R''''$ ($t \geqq 40$; R'''': an alkyl group having 1 to 20 carbon atoms or H)

For example, the compound represented by the above Formula (VIII) can be obtained by modifying the compound represented by Formula (I) (the wax alcohol produced by the process disclosed in U.S. Pat. No. 2,892,858, or UNILINE, available from Petrolite Corporation).

There are no particular limitations on the manner of modifying the compound represented by Formula (I) to obtain the compound represented by Formula (III). As an example, one method is shown below.

The compound represented by Formula (I), $CH_3(CH_2CH_2)_1OH$ ($1 \geqq 20$), is reacted with NaOH pellets under heating and, after cooling, toluene and $H_2SO_4$ are added to the reaction mixture, followed by filtration, washing with water and removal of the solvent, thereby modifying the compound represented by Formula (I) to obtain the compound represented by Formula (VIII), $CH_3(CH_2CH_2)_qCOOH$ ($q \geqq 20$).

In the present invention, there are no particular limitations on the carboxylic acid with which the monohydroxylic compound is reacted. As examples thereof, there may be named monocarboxylic acids such as formic acid, acetic acid, propionic acid, lactic acid, isolactic acid, valeric acid, pivaric acid, lauric acid, myristic acid, palmitic acid, stearic acid, acrylic acid, propionic acid, methacrylic acid, crotonic acid and oleic acid, and acid anhydrides thereof; heterocyclic carboxylic acids such as furoric acid, nicotinic acid, isonicotinic acid; unsaturated dicarboxylic acids such as fumaric acid, maleic acid, citraconic acid and itaconic acid, and acid anhydrides thereof; saturated dicarboxylic acids such as succinic acid, adipic acid, sebasic acid and azelaic acid, and acid anhydrides thereof; and carbocyclic carboxylic acids such as benzoic acid, toluic acid, naphathoic acid, cinnamic acid, phthalic acid, terephthalic acid, trimellitic acid and pyromellitic acid, and acid anhydrides thereof. They may be used alone or in a combination of two or more kinds.

Of these, dibasic or higher carboxylic acids are particularly preferred in view of the improvement in the viscosity, plasticity and molecular weight control attributable to the ester compound α.

In the present invention, the carboxylic acid with which the monohydroxylic compound is reacted may have a molecular weight of 1,000 or less, preferably from 50 to 1,000, more preferably from 100 to 1,000, in view of the viscosity, plasticity and molecular weight control attributable to the ester compound α. If this carboxylic acid has a molecular weight more than 1,000, it may become difficult to achieve the viscosity and plasticity control attributable to the ester compound α.

In the present invention, there are no particular limitations on the alcohol with which the monocarboxylic compound is reacted. As examples thereof, there may be named monohydric alcohols such as methyl alcohol, ethyl alcohol, propyl alcohol, isopropyl alcohol, butyl alcohol, isobutyl alcohol, sec-butyl alcohol, tert-butyl alcohol, n-amyl alcohol, isoamyl alcohol, hexyl alcohol, heptyl alcohol, octyl alcohol, capryl alcohol, allyl alcohol, crotyl alcohol, propargyl alcohol, cyclopentanol, cyclohexanol, benzyl alcohol, cinnamyl alcohol and furfuryl alcohol; and diols such as ethylene glycol, propylene glycol, 1,3-butanediol, 1,4-butanediol, 2,3-butanediol, diethylene glycol, dipropylene glycol, triethylene glycol, 1,5-pentanediol, 1,6-hexanediol, neopentyl glycol, pentaerythritol diallyl ether, trimethylene glycol, 2-ethyl-1,3-hexanediol, hydrogenated bisphenol A, and a bisphenol derivative represented by the formula:

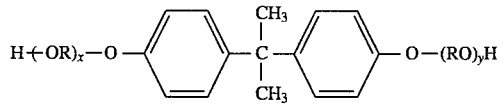

wherein R represents an ethylene group or a propylene group, and x and y are each an integer of i or more, and total 2 to 10. They may be used alone or in a combination of two or more kinds.

Of these, dihydric or higher alcohols are particularly preferred in view of the improvement in the viscosity, plasticity and molecular weight control attributable to the ester compound β.

In the present invention, the alcohol with which the monocarboxylic compound is reacted may have a molecular weight of 1,000 or less, preferably from 50 to 1,000, more preferably from 100 to 1,000, in view of the improvement in the viscosity, plasticity and molecular weight control attributable to the ester compound β. If this alcohol has a molecular weight more than 1,000, it may become difficult to achieve the viscosity and plasticity control attributable to the ester compound β.

In the present invention, the values of weight average molecular weight (Mw) and number average molecular weight (Mn) of the monohydroxylic compound, monocarboxylic compound, ester compound α and ester compound β are determined by gel permeation chromatography (GPC). The GPC is carried out under the following conditions.

Apparatus: GPC-150 (Waters Co.)

Columns: GMH-HT 30 cm, two series (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

An example of the measuring method is as follows:

A surfactant as a dispersant is added in an aqueous electrolyte solution (e.g. aqueous NaCl solution), to which a sample to be measured is further added. The electrolyte solution in which the sample is suspended, is measured by a coulter counter method after dispersion treatment with a supersonic dispersion apparatus.

On the measuring under the conditions described above, the molecular weight of the sample is calculated from a molecular weight calibration curve prepared by the use of a monodisperse polystyrene standard sample. The value calculated is further converted to polyethylene according to a conversion formula derived from the Mark-Houwink viscosity formula.

In the present invention, as the values of the molecular weight of the carboxylic acid with which the monohydroxylic compound is reacted and that of the alcohol with which the monocarboxylic compound is reacted, it is preferable to use the values measured by GC-MS on the samples subjected to derivative-forming treatment such as silylation, methylation or the like.

In the present invention, there are no particular limitations on the binder resin of the toner so long as it is a thermoplastic resin. Polyester resins and styrene-acrylic resins are preferred.

There are no particular limitations on the polyester resins, and commonly available polyester resins may be used. As monomers that constitute the polyester resins, the following substances may be used, while not limited thereto.

As an alcohol component, there may be named diols such as ethylene glycol, propylene glycol, 1,3-butanediol, 1,4-butanediol, 2,3-butanediol, diethylene glycol, dipropylene glycol, triethylene glycol, 1,5-pentanediol, 1,6-hexanediol, neopentyl glycol, pentaerythritol diallyl ether, trimethylene glycol, 2-ethyl-1,3-hexanediol, hydrogenated bisphenol A, and the bisphenol derivative represented by the formula previously set forth.

As an acid component, there may be named unsaturated dicarboxylic acids such as fumaric acid, maleic acid, citraconic acid and itaconic acid, or acid anhydrides of these; dicarboxylic acids such as succinic acid, adipic acid, sebacic acid and azelaic acid, or acid anhydrides of these; and aromatic dicarboxylic acids such as phthalic acid and terephthalic acid.

As a trihydric or higher alcohol, there may be named glycerol, sorbitol and sorbitan; and as a tribasic or higher acid, trimellitic acid, pyromellitic acid and acid anhydrides of these.

There are no particular limitations on the manner by which the polyester resin used in the present invention is produced. Conventionally known production processes may be used.

There are no particular limitations on the styrene-acrylic resins, and commonly available styrene-acrylic resins may be used. As monomers that constitute the styrene-acrylic resins, the following substances may be used, while not limited thereto.

For example, they may include styrene, and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; a-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; acrylic acid or methacrylic acid derivatives such as acrylonitrile, methacrylonitrile and acrylamide; acroleins; and carboxyl group-containing vinyl monomers such as acrylic acid, methacrylic acid, crotonic acid, itaconic acid, maleic anhydride, fumaric acid, maleic acid, and monoesters thereof such as methyl, ethyl, butyl or 2-ethylhexyl esters.

In the present invention, combinations of styrene monomers, methacrylic or acrylic monomers and carboxyl group-containing monomers are particularly preferred.

As the binder resin of the toner, besides the polyester resins and the styrene-acrylic resins, there may be used styrene copolymers of styrene with other vinyl monomers, such as a styrene-methyl vinyl ether copolymer, a styrene-butadiene copolymer, a styrene-methyl vinyl ketone copolymer and a styrene-acrylonitrile-indene copolymer; and polymethyl methacrylate, polybutyl methacrylate, polyvinyl acetate, polyamide, epoxy resin, polyvinyl butyral, polyacrylic acid, phenol resin, aliphatic or alicyclic hydrocarbon resins, petroleum resins, and chlorinated paraffin.

In the present invention, a negative or positive charge control agent may be optionally used.

The charge control agent used in the present invention may include the following.

Charge control agents capable of controlling the toner to be negatively chargeable include the following materials.

For example, organic metal complexes or chelate compounds are effective, including monoazo metal complexes, acetylacetone metal complexes, and metal complexes of an aromatic hydroxycarboxylic acid type or aromatic dicarboxylic acid type, and also including aromatic hydroxycarboxylic acids, aromatic mono- or polycarboxylic acids and metal salts, anhydrides or esters thereof; and phenol derivatives such as bisphenol.

Those capable of controlling the magnetic toner to be positively chargeable include the following materials.

For example, they include Nigrosine and modified products thereof, modified with a fatty acid metal salt; quaternary ammonium salts such as tributylbenzylammonium 1-hydroxy-4-naphthosulfonate and tetrabutylammonium teterafluoroborate, and analogues of these, including onium salts such as phosphonium salts and lake pigments of these; triphenylmethane dyes and lake pigments of these (lake-forming agents may include phosphotungstic acid, phosphomolybdic acid, phosphotungstomolybdic acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds. Of these, Nigrosine types or quaternary ammonium salts are particularly preferably used.

In the present invention, as the colorant, there may be used magnetic materials including metals such as iron, cobalt and nickel, or alloys or mixtures of any of these metals with a metal such as aluminum, cobalt, copper, lead, magnesium, tin, zinc, antimony, beryllium, bismuth, cadmium, calcium, manganese, selenium, titanium, tungsten or vanadium.

These magnetic materials, ferromagnetic materials, may have an average particle diameter of from about 0.1 to 2 μm, preferably from about 0.1 to 0.5 μm, and may be contained in the toner in an amount of from about 20 to 200 parts by weight based on 100 parts by weight of the binder resin, particularly preferably from 40 to 150 parts by weight based on 100 parts by weight of the binder resin.

The magnetic material may preferably have a coercive force of from 20 to 150 oersteds, a saturation magnetization of from 50 to 200 emu/g and a residual magnetization of from 2 to 20 emu/g as magnetic properties under application of 10K oersteds.

The magnetic toner having such a magnetic material can be used as a magnetic one-component developer comprised of only the toner.

In addition to the above magnetic material, the colorant usable in the present invention may also include any suitable pigment or dye. The pigment may include, for example, carbon black, aniline black, acetylene black, Naphthol Yellow, Hanza Yellow, Rhodamine Lake, Alizarine Lake, red iron oxide, Phthalocyanine Blue and Indanethrene Blue.

Any of these may be used in a quantity necessary and sufficient for maintaining the optical density of fixed images, and may be added in an amount of from 0.1 to 20 parts by weight, preferably from 2 to 10 parts by weight, based on 100 parts by weight of the resin components. The dye may include, for example, azo dyes, anthraquinone dyes, xanthene dyes and methine dyes, and may be added in an amount of from 0.1 to 20 parts by weight, preferably from 0.3 to 3 parts by weight, based on 100 parts by weight of the resin components for the same purpose as in the case of the pigments.

A color toner containing such a pigment or dye can be used as a non-magnetic one-component developer comprised of only the toner without being blended with a carrier, or may be blended with a carrier so as to be used as a two-component developer comprised of the toner and the carrier.

As the carrier, all known carriers can be used, including, for example, powders having magnetic properties, such as iron powder, ferrite powder and nickel powder, glass beads, and any of these materials whose particle surfaces have been treated with a resin such as a fluorine resin, a vinyl resin or a silicone resin.

To the toner of the present invention, a waxy material such as low-molecular weight polyethylene or low-molecular weight polypropylene may be added in an amount of from about 0.5 to 10 parts by weight based on 100 parts by weight of the binder resin in order to more improve the anti-offset properties at the time of heat roll fixing.

The toner according to the present invention can be produced by thoroughly mixing the binder resin, the ester compound $\alpha$ or $\beta$ previously described, the pigment, dye or magnetic material as the colorant, and optionally the charge control agent, the metal salt or metal complex and other additives by means of a mixing machine such as a Henschel mixer or a ball mill, thereafter melt-kneading the mixture using a heat kneading machine such as a heat roll, a kneader or an extruder to make the resins melt compatibly, dispersing or dissolving the metal compound, pigment, dye or magnetic material in the molten product, and cooling the resulting dispersion or solution to solidify, followed by pulverization and classification to obtain toner particles.

The toner particles obtained may be well blended with desired additives if necessary, by means of a mixing machine such as a Henschel mixer. Thus the toner according to the present invention can be obtained.

In the toner of the present invention, a fine silica powder may preferably be added in order to improve charge stability, developing performance, fluidity and operational performance.

The fine silica powder used in the present invention can provide good results when it has a specific surface area of 30 $m^2/g$ or more, particularly from 50 to 400 $m^2/g$, as measured by the BET method using nitrogen adsorption. The fine silica powder may be used in an amount of from 0.01 to 8 parts by weight, preferably from 0.1 to 5 parts by weight, based on 100 parts by weight of the toner.

For the purpose of making hydrophobic and controlling chargeability, the fine silica powder used in the present invention may have been optionally treated with a treating agent such as silicone varnish, modified silicone varnish of various types, silicone oil, modified silicone oil of various types, silicone oil, a silane coupling agent, a silane coupling agent having a functional group or other organosilicon compound, any of which may be appropriately used alone or in combination.

As other additives, there may be used lubricants as exemplified by Teflon, zinc stearate and polyvinylidene fluoride; abrasives as exemplified by cerium oxide, silicon carbide and strontium titanate (in particular, strontium titanate is preferred); fluidity-providing agents as exemplified by titanium oxide and aluminum oxide (in particular, hydrophobic one is preferred); anti-caking agents; conductivity-providing agents as exemplified by carbon black, zinc oxide, antimony oxide and tin oxide; and developability improvers such as reverse-polarity white fine particles and reverse-polarity black fine particles.

In the present invention, from the viewpoint of the future trend toward higher image quality, the toner may preferably have a volume average particle diameter of from 3 to 8 μm. In the present invention, the volume average particle diameter may preferably be measured by the Coulter counter method.

An image forming apparatus and a process cartridge that make use of the toner of the present invention will be described below with reference to FIG. 1.

The surface of a photosensitive member 1 (an electrostatic latent image bearing member) is positively charged by a primary charging assembly 2 (a charging means), and the charged surface is subjected to optical image exposure (latent image forming means) 5 (slit exposure or laser beam exposure) to form a latent image (analog or digital) by image scanning. The latent image formed is developed using a negatively chargeable one-component magnetic toner 10 held in a developing assembly (a developing means) 9 equipped with a magnetic blade 11 and a developing sleeve 4 internally provided with a magnet 14. In the developing zone, an alternating bias, a pulse bias and/or a DC bias is/are applied between a conductive substrate of the photosensitive drum (photosensitive member) 1 and the developing sleeve 4 through a bias applying means 12. A transfer medium P is fed and delivered to the transfer zone, where the transfer medium P is charged by a secondary charging means (a transfer means) 3 from its back surface (the surface opposite to the photosensitive drum), so that the developed image (a toner image) on the surface of the photosensitive drum 1 is electrostatically transferred to the transfer medium P. The transfer medium P separated from the photosensitive drum 1 is subjected to fixing using a heat-pressure roller fixing assembly 7 so that the toner image on the transfer medium P is fixed.

The one-component developer remaining on the photosensitive drum after the transfer step is removed by the operation of a cleaning means 8 having a cleaning blade. After the cleaning, the residual charges on the surface of the photosensitive drum 1 is eliminated by erase exposure 6, and thus the procedure again starting from the charging step using the primary charging assembly 2 is repeated.

The electrostatic latent image bearing member (photosensitive drum) 1 comprises a photosensitive layer and the conductive substrate, and is rotated in the direction of an arrow. In the developing zone, a developing sleeve 4 formed of a non-magnetic cylinder, which is a toner carrying member, is rotated so as to move in the same direction as the surface movement of the electrostatic latent image bearing member. Inside the non-magnetic cylindrical developing sleeve 4, the toner carrying member, a multi-polar permanent magnet (magnet roll) serving as a magnetic field generating means is provided in an unrotatable state. The one-component insulating magnetic developer 10 held in the developing assembly 9 is applied on the surface of the non-magnetic cylinder (developing sleeve), and, for example, minus triboelectric charges are imparted to its toner particles due to the friction between the surface of the developing sleeve 4 and the toner particles. A magnetic doctor blade 11 made of iron is disposed in proximity (preferably with a space of from 50 μm to 500 μm) to the surface of the cylinder and also opposingly to one of the magnetic pole positions of the multi-polar permanent magnet. Thus, the thickness of a developer layer can be controlled to be small (preferably from 30 μm to 300 μm) and uniform so that a developer layer smaller in thickness than the gap between the electrostatic latent image bearing member (photosensitive drum) 1 and the toner carrying member (developing sleeve) 4 in the developing zone can be formed in a non-contact state. The rotational speed of this toner carrying member 4 is regulated so that the peripheral speed of the sleeve can be substantially equal or close to the peripheral speed of the electrostatic latent image bearing member. As the magnetic doctor blade 11, a permanent magnet may be used in place of iron to form an opposing magnetic pole. In the developing zone, an AC bias or pulse bias may be applied through a bias means 12 between the toner carrying member 4 and the surface of the electrostatic latent image bearing member.

When the toner particles are moved in the developing zone, the toner particles move to the side of the electrostatic latent image bearing member by the electrostatic force of the surface of the electrostatic latent image bearing member and the action of the AC bias or pulse bias.

In place of the magnetic doctor blade 11, an elastic blade formed of an elastic material such as silicone rubber may be used so that the layer thickness of the developer layer can be controlled by pressing it against the surface of the toner carrying member to apply the developer thereon in a given thickness.

An electrophotographic apparatus may be constituted of a combination of plural components integrally joined as a process cartridge from among the constituents such as the above electrostatic latent image bearing member, developing means and cleaning means so that the process cartridge is detachable from the body of the image forming apparatus (e.g., a copying machine, a laser beam printer and a facsimile machine). For example, the developing means and the electrostatic latent image bearing member may be integrally supported in a cartridge to form the process cartridge detachable from the body of the apparatus while using a guide means such as a rail provided in the body of the apparatus. In that case, the charging means and/or developing means also may be set in the process cartridge.

In the case where the image forming apparatus is used as a copying machine or a printer, the photosensitive member is subjected to the optical image exposure 5 by irradiation with the reflected, or transmitted light from, an original, or by scanning with a laser beam, driving an LED array or driving a liquid crystal shutter array according to the signalized information read out from an original.

Figure 2:
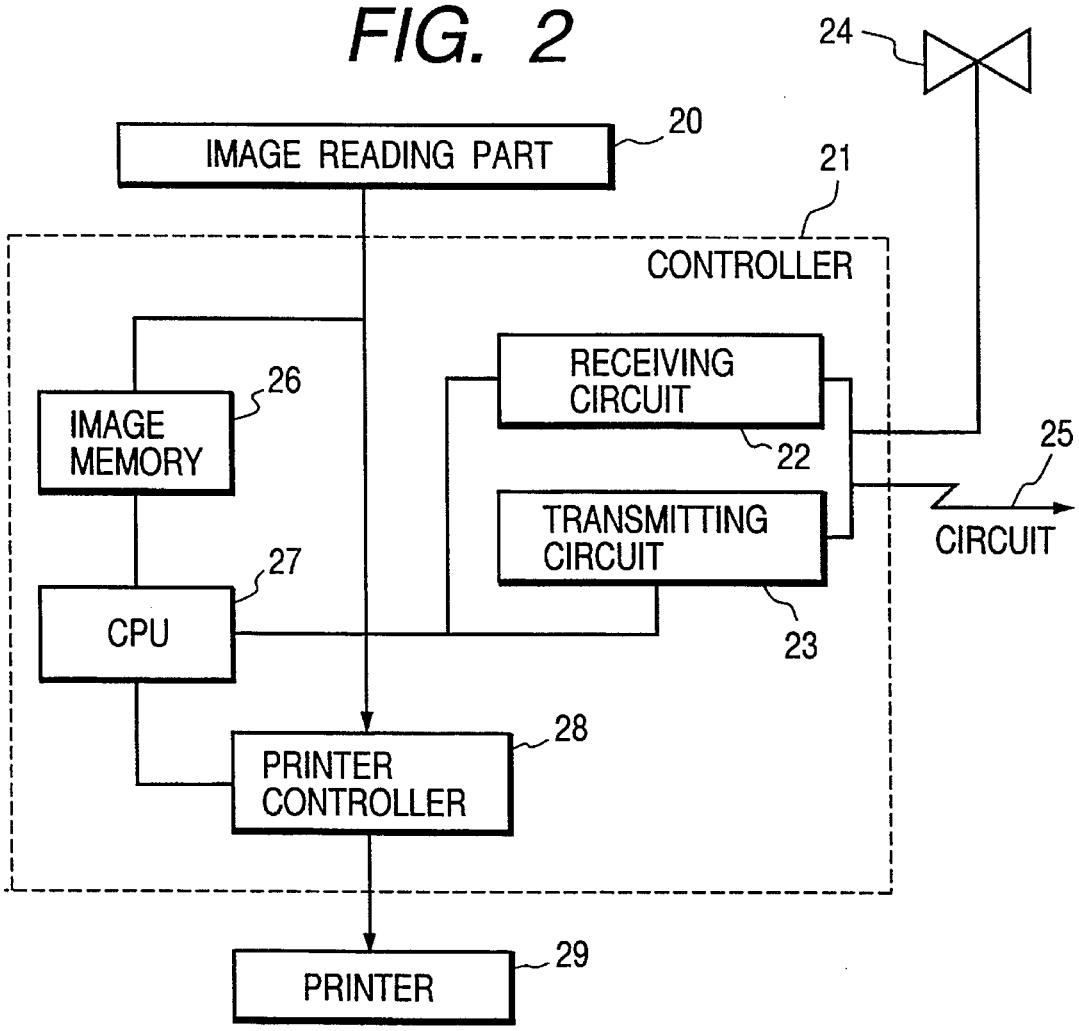
FIG. 2 shows a block diagram of a facsimile machine in which the image forming apparatus is used as a printer.

When the image forming apparatus of the present invention is used as a printer of a facsimile machine, the optical image exposure 5 serves as exposure for printing the received data. FIG. 2 illustrates an example thereof in the form of a block diagram.

A controller 21 controls an image reading part 20 and a printer 29. The whole of the controller 21 is controlled by CPU 27. The image data outputted from the image reading part is sent to the other facsimile station through a transmitting circuit 23. The data received from the other station is sent to a printer 29 through a receiving circuit 22. Given image data are stored in an image memory 26. A printer controller 28 controls the printer 29. The numeral 24 denotes a telephone.

An image received from a circuit 25 (image information from a remote terminal connected through the circuit) is demodulated in the receiving circuit 22, and then successively stored in an image memory 26 after the image information is decoded by the CPU 27. Then, when images for at least one page have been stored in the memory 26, the image recording for that page is carried out. The CPU 27 reads out the image information for one page from the memory 26 and sends the coded image information for one page to the printer controller 28. The printer controller 28, having received the image information for one page from the CPU 27, controls the printer 29 so that the image information for one page is recorded.

The CPU 27 receives image information for next page in the course of the recording by the printer 29.

Images are received and recorded in this way.

In the present invention, the toner contains the reaction product between i) the monohydroxylic compound having a long-chain alkyl group having an alkylene group with 40 or more carbon atoms and a hydroxyl group and ii) the carboxylic acid having a molecular weight of 1,000 or less (the ester compound α), or the reaction product between i) the monocarboxylic compound having a long-chain alkyl group having an alkylene group with 40 or more carbon atoms and a carboxyl group and ii) the alcohol having a molecular weight of 1,000 or less (the ester compound β). Hence, the toner can achieve superior fixing performance and anti-offset properties, and can stably give the fixed images having a good image density in an environment of low humidity even with a high-speed image forming apparatus having a process speed of 380 mm/sec or higher.

The present invention will be described below by giving specific Examples. The present invention is by no means limited thereto.

EXAMPLES

Production Examples of the compound (ester compound α) obtained by reacting the monohydroxylic compound with the carboxylic acid and the compound (ester compound β) obtained by reacting the monocarboxylic compound with the alcohol are shown below.

| Production Example 1 | (by weight) |
|---|---|
| $CH_3(CH_2)_{54}OH$ | 2,364 parts |
| 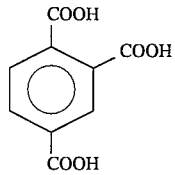 | 210 parts |

The above compounds were reacted in the presence of monobutyltin oxide, and the reaction product was taken out after a reaction time of 150 minutes. This product was designated as ester compound A.

Mn (number average molecular weight) and Mw (weight average molecular weight) of the ester compound A as measured by GPC were Mn: 2,361 and Mw: 2,516, respectively.

| Production Example 2 | (by weight) |
|---|---|
| $CH_3(CH_2)_{47}OH$ | 2,070 parts |
| 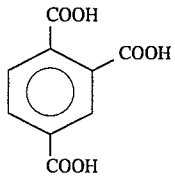 | 210 parts |

The above compounds were reacted in the presence of monobutyltin oxide, and the reaction product was taken out after a reaction time of 120 minutes. This product was designated as ester compound B.

Mn (number average molecular weight) and Mw (weight average molecular weight) of the ester compound B as measured by GPC were Mn: 2,020 and Mw: 2,190, respectively.

| Production Example 3 | (by weight) |
|---|---|
| $CH_3(CH_2)_{54}OH$ | 3,152 parts |
| 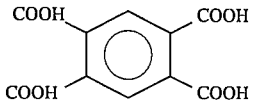 | 254 parts |

The above compounds were reacted in the presence of monobutyltin oxide, and the reaction product was taken out after a reaction time of 150 minutes. This product was designated as ester compound C.

Mn (number average molecular weight) and Mw (weight average molecular weight) of the ester compound C as measured by GPC were Mn: 3,118 and Mw: 3,336, respectively.

| Production Example 4 | (by weight) |
|---|---|
| $CH_3(CH_2)_{54}OH$ | 1,576 parts |
| 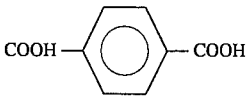 | 166 parts |

The above compounds were reacted in the presence of monobutyltin oxide, and the reaction product was taken out after a reaction time of 150 minutes. This product was designated as ester compound D.

Mn (number average molecular weight) and Mw (weight average molecular weight) of the ester compound D as measured by GPC were Mn: 1,605 and Mw: 1,702, respectively.

| Production Example 5 | (by weight) |
|---|---|
| $CH_3(CH_2)_{54}OH$ | 788 parts |
| 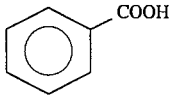 | 122 parts |

The above compounds were reacted in the presence of monobutyltin oxide, and the reaction product was taken out after a reaction time of 150 minutes. This product was designated as ester compound E.

Mn (number average molecular weight) and Mw (weight average molecular weight) of the ester compound E as measured by GPC were Mn: 839 and Mw: 890, respectively.

| Production Example 6 | (by weight) |
|---|---|
| $CH_3(CH_2)_{35}OH$ | 1,566 parts |
| 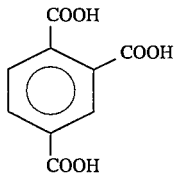 | 210 parts |

The above compounds were reacted in the presence of monobutyltin oxide, and the reaction product was taken out after a reaction time of 150 minutes. This product was designated as ester compound F.

Mn (number average molecular weight) and Mw (weight average molecular weight) of the ester compound F as measured by GPC were Mn: 1,635 and Mw: 1,740, respectively.

| Production Example 7 | (by weight) |
|---|---|
| $CH_3(CH_2)_{26}OH$ | 1,584 parts |
| 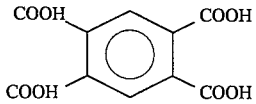 | 254 parts |

The above compounds were reacted in the presence of monobutyltin oxide, and the reaction product was taken out after a reaction time of 120 minutes. This product was designated as ester compound G.

Mn (number average molecular weight) and Mw (weight average molecular weight) of the ester compound G as measured by GPC were Mn: 1,690 and Mw: 1,812, respectively.

| Production Example 8 | (by weight) |
|---|---|
| $CH_3(CH_2)_{26}OH$ | 792 parts |
| 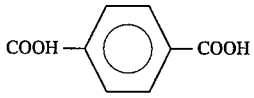 | 166 parts |

The above compounds were reacted in the presence of monobutyltin oxide, and the reaction product was taken out after a reaction time of 120 minutes. This product was designated as ester compound H.

Mn (number average molecular weight) and Mw (weight average molecular weight) of the ester compound H as measured by GPC were Mn: 801 and Mw: 931, respectively.

| Production Example 9 | (by weight) |
|---|---|
| $CH_3(CH_2)_{17}OH$ | 810 parts |
| 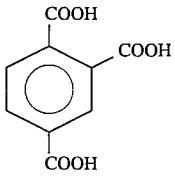 | 210 parts |

The above compounds were reacted in the presence of monobutyltin oxide, and the reaction product was taken out after a reaction time of 150 minutes. This product was designated as ester compound I.

Mn (number average molecular weight) and Mw (weight average molecular weight) of the ester compound I as measured by GPC were Mn: 920 and Mw: 1,005, respectively.

| Production Example 10 | (by weight) |
|---|---|
| $CH_3(CH_2)_{56}COOH$ | 1,688 parts |
| 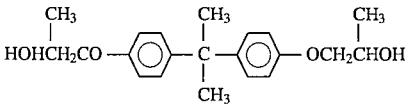 | 330 parts |

The above compounds were reacted in the presence of monobutyltin oxide, and the reaction product was taken out after a reaction time of 120 minutes. This product was designated as ester compound J.

Mn (number average molecular weight) and Mw (weight average molecular weight) of the ester compound J as measured by GPC were Mn: 1,890 and Mw: 2,005, respectively.

| Production Example 11 | (by weight) |
|---|---|
| $CH_3(CH_2)_{46}COOH$ | 2,112 parts |
| $HOH_2C-C(CH_2OH)_2-CH_2CH_3$ | 134 parts |

The above compounds were reacted in the presence of monobutyltin oxide, and the reaction product was taken out after a reaction time of 150 minutes. This product was designated as ester compound K.

Mn (number average molecular weight) and Mw (weight average molecular weight) of the ester compound K as measured by GPC were Mn: 2,041 and Mw: 2,181, respectively.

| Production Example 12 | (by weight) |
|---|---|
| $CH_3(CH_2)_{56}COOH$ | 5,064 parts |

-continued

| Production Example 12 | (by weight) |
|---|---|
| $HOH_2C-C(CH_2OH)_2-CH_2-O-CH_2-C(CH_2OH)_2-CH_2OH$ | 254 parts |

The above compounds were reacted in the presence of monobutyltin oxide, and the reaction product was taken out after a reaction time of 120 minutes. This product was designated as ester compound L.

Mn (number average molecular weight) and Mw (weight average molecular weight) of the ester compound L as measured by GPC were Mn: 4,843 and Mw: 5,181, respectively.

| Production Example 13 | (by weight) |
|---|---|
| $CH_3(CH_2)_{56}COOH$ | 844 parts |
| $HOH_2C-C(CH_3)_2-CH_2OH$ | 104 parts |

The above compounds were reacted in the presence of monobutyltin oxide, and the reaction product was taken out after a reaction time of 120 minutes. This product was designated as ester compound M.

Mn (number average molecular weight) and Mw (weight average molecular weight) of the ester compound M as measured by GPC were Mn: 841 and Mw: 891, respectively.

| Production Example 14 | (by weight) |
|---|---|
| $CH_3(CH_2)_{56}COOH$ | 844 parts |
| $CH_3-C(CH_3)_2-CH_2OH$ | 88 parts |

The above compounds were reacted in the presence of monobutyltin oxide, and the reaction product was taken out after a reaction time of 120 minutes. This product was designated as ester compound N.

Mn (number average molecular weight) and Mw (weight average molecular weight) of the ester compound N as measured by GPC were Mn: 847 and Mw: 907, respectively.

| Production Example 15 | (by weight) |
|---|---|
| $CH_3(CH_2)_{34}COOH$ | 1,608 parts |
| $HOH_2C-C(CH_2OH)_2-CH_2CH_3$ | 134 parts |

The above compounds were reacted in the presence of monobutyltin oxide, and the reaction product was taken out after a reaction time of 120 minutes. This product was designated as ester compound O.

Mn (number average molecular weight) and Mw (weight average molecular weight) of the ester compound O as measured by GPC were Mn: 1,602 and Mw: 1,701, respectively.

| Production Example 16 | (by weight) |
|---|---|
| $CH_3(CH_2)_{27}COOH$ | 2,628 parts |
| $HOH_2C-C(CH_2OH)_2-H_2C-O-CH_2-C(CH_2OH)_2-CH_2OH$ | 254 parts |

The above compounds were reacted in the presence of monobutyltin oxide, and the reaction product was taken out after a reaction time of 150 minutes. This product was designated as ester compound P.

Mn (number average molecular weight) and Mw (weight average molecular weight) of the ester compound P as measured by GPC were Mn: 2,631 and Mw: 2,816, respectively.

| Production Example 17 | (by weight) |
|---|---|
| $CH_3(CH_2)_{27}COOH$ | 876 parts |
| $HOH_2C-C(CH_3)_2-CH_2OH$ | 104 parts |

The above compounds were reacted in the presence of monobutyltin oxide, and the reaction product was taken out after a reaction time of 120 minutes. This product was designated as ester compound Q.

Mn (number average molecular weight) and Mw (weight average molecular weight) of the ester compound Q as measured by GPC were Mn: 821 and Mw: 961, respectively.

| Production Example 18 | (by weight) |
|---|---|
| $CH_3(CH_2)_{17}COOH$ | 596 parts |
| $HOH_2C-C(CH_3)_2-CH_2OH$ | 104 parts |

The above compounds were reacted in the presence of monobutyltin oxide, and the reaction product was taken out after a reaction time of 120 minutes. This product was designated as ester compound R.

Mn (number average molecular weight) and Mw (weight average molecular weight) of the ester compound R as measured by GPC were Mn: 590 and Mw: 688, respectively.

The number average molecular weights and weight average molecular weights of the ester compounds A to R produced in Production Examples 1 to 18 and of the monohydroxylic compound and monocarboxylic compound, used in the reaction, the molecular weights of the carboxylic acid and alcohol and the carbon atom numbers of the alkylene groups in the monohydroxylic compound and monocarboxylic compound are shown in Tables 1 and 2.

TABLE 1

| | Monohydroxylic compound | | | | | Ester compound | | |
|---|---|---|---|---|---|---|---|---|
| Production Example | Alkylene carbon atoms | Number average molecular weight (Mn) | Weight average molecular weight (Mw) | Mw/Mn | Carboxylic acid Molecular weight | Ester compound | Number average molecular weight (Mn) | Weight average molecular weight (Mw) |
| 1 | 54 | 792 | 840 | 1.06 | 210 | A | 2,361 | 2,516 |
| 2 | 46 | 681 | 729 | 1.07 | 210 | B | 2,014 | 2,174 |
| 3 | 54 | 792 | 840 | 1.06 | 254 | C | 3,118 | 3,336 |
| 4 | 54 | 792 | 840 | 1.06 | 166 | D | 1,605 | 1,702 |
| 5 | 54 | 792 | 840 | 1.06 | 122 | E | 839 | 890 |
| 6 | 36 | 541 | 579 | 1.07 | 210 | F | 1,611 | 1,721 |
| 7 | 26 | 399 | 427 | 1.07 | 254 | G | 1,690 | 1,812 |
| 8 | 26 | 399 | 427 | 1.07 | 166 | H | 801 | 931 |
| 9 | 18 | 288 | 308 | 1.07 | 210 | I | 941 | 996 |

TABLE 2

| | Monocarboxylic compound | | | | | Ester compound | | |
|---|---|---|---|---|---|---|---|---|
| Production Example | Alkylene carbon atoms | Number average molecular weight (Mn) | Weight average molecular weight (Mw) | Mw/Mn | Alcohol Molecular weight | Ester compound | Number average molecular weight (Mn) | Weight average molecular weight (Mw) |
| 10 | 56 | 845 | 896 | 1.06 | 330 | J | 1,890 | 2,005 |
| 11 | 46 | 705 | 754 | 1.07 | 134 | K | 2,041 | 2,181 |
| 12 | 56 | 845 | 896 | 1.06 | 254 | L | 4,843 | 5,181 |

TABLE 2-continued

| | Monocarboxylic compound | | | | | Ester compound | | |
|---|---|---|---|---|---|---|---|---|
| Production Example | Alkylene carbon atoms | Number average molecular weight (Mn) | Weight average molecular weight (Mw) | Mw/Mn | Alcohol Molecular weight | Ester compound | Number average molecular weight (Mn) | Weight average molecular weight (Mw) |
| 13 | 56 | 845 | 896 | 1.06 | 104 | M | 841 | 891 |
| 14 | 56 | 845 | 896 | 1.06 | 88 | N | 847 | 907 |
| 15 | 34 | 537 | 575 | 1.07 | 134 | O | 1,602 | 1,701 |
| 16 | 26 | 427 | 457 | 1.07 | 254 | P | 2,505 | 2,681 |
| 17 | 26 | 427 | 457 | 1.07 | 104 | Q | 847 | 906 |
| 18 | 18 | 315 | 337 | 1.07 | 104 | R | 585 | 681 |

| Example 1 | (by weight) |
|---|---|
| Polyester resin (polyester composed of bisphenol A, trimellitic acid, terephthalic acid and neopentyl glycol; Mw: 45,000) | 100 parts |
| Magnetic iron oxide | 90 parts |
| Negatively chargeable charge control agent | 2 parts |
| Ester compound A | 3 parts |

The above materials were thoroughly mixed using a blender, and then melt-kneaded using a twin-screw extruder set at 140° C. The kneaded product obtained was cooled, and then granulated with a cutter mill. Thereafter the crushed product was finely pulverized by means of a pulverizer utilizing jet streams, and the finely pulverized product thus obtained was classified to give a magnetic fine black powder (a toner) with a volume average particle diameter of 6.52 μm. To 100 parts by weight of the magnetic fine black powder thus obtained, 0.6 part by weight of negatively chargeable, hydrophobic dry-process colloidal silica (BET specific surface area: 300 $m^2/g$) was added, followed by mixing by means of a Henschel mixer, obtaining a magnetic toner, which served as a one-component magnetic developer.

This one-component magnetic developer was applied to a commercially available copying machine NP-9800 (process speed: 503 mm/sec), manufactured by Canon Inc., the image forming apparatus as shown in FIG. 1, and images were reproduced under the environmental conditions of normal temperature and low humidity (23.5° C./5%RH). The test results of the image reproduction are shown in Table 3. As is seen from Table 3, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.3% in an environment of 15° C./10%RH and 8.7% in an environment of 7.5° C./10%RH, which were on a good level. Good results were also obtained for the anti-offset properties.

The resolution, which is an evaluation standard for the image characteristics of copied images, was of 8.0 lines/mm even after 30,000 sheets copying, and as good and stable as the initial stage.

In the foregoing Example, the charge quantity of the toner layer on the developing sleeve, the resolution of copied images as an evaluation standard for the image characteristics of copied images, the fixing performance, and the anti-offset properties were evaluated in the following way.

* Charge quantity of the toner layer on the developing sleeve:

Charge quantity of the toner layer per unit area on the developing sleeve was determined by what is called the suction type Faraday's cage method. More specifically, an outer cylinder of the cage was pressed against the developing sleeve to suck up all the toner in a given area on the developing sleeve, and at the same time the charges accumulated in an inner cylinder electrostatically shielded from the outside was measured, whereby the charge quantity per unit area on the developing sleeve was determined.

* Resolution of copied images:

In the present invention, the resolution of copied images was measured in the following manner: An original image is made, which is composed of patterns each of which is comprised of five fine lines with equal line width and line distance, where the 5 lines patterns are drawn to have 2.8, 3.2, 3.6, 4.0, 4.5, 5.0, 5.6, 6.3, 7.1, 8.0, 9.0 and 10.0 lines/mm, respectively. The original image having these twelve kinds of line images is copied under proper copying conditions. The copied images are observed with a magnifier, and the number of lines (lines/mm) of images whose fine lines are clearly separate from one another is regarded as a value of the resolution. The greater this number is, the higher the resolution is.

* Fixing performance:

To test fixing performance, the evaluation machine was left standing overnight in an environment of low temperature and low humidity (15° C./10%RH and 7.5° C./10%RH) until the evaluation machine and its inside fixing assembly completely adjusted to the environment. Under this condition, copies were continuously taken on 200 sheets, and a copied image on the 200th sheet was used for the evaluation of the fixing performance. The images were rubbed 10 times using Silbon paper under a load of about 100 g, examining release of the images, which was evaluated as the rate (%) of decrease in reflection density. Thus, the greater the value of the rate of decrease in reflection density (rate of decrease in image density) is, the more the image release rate is and the poorer the fixing performance of the toner is.

* Anti-offset properties:

Evaluation of anti-offset properties was made on the basis of whether or not, when copies were successively taken, the toner once taken by a cleaning web transferred onto the fixing roller to contaminate the copies. As the evaluation method, in an environment of low temperature and low humidity (15° C./10%RH), copies were successively taken for 200 sheets and thereafter 7 copies were taken sheet by sheet at an intervals of 30 seconds and examined on whether or not image stain occurred. Also, in an environment of low temperature and low humidity (7.5° C./10%RH), copies were successively taken for 500 sheets and thereafter 7 copies were taken sheet by sheet at an intervals of 30 seconds and examined on whether or not image stain occurred. The anti-offset properties of the toner were evaluated according to the following evaluation criteria.

A: No image stain occurred.

C: Image stain occurred.

EXAMPLE 2

A magnetic fine black powder (a toner) with a volume average particle diameter of 6.24 μm was obtained using the same materials and following the same procedure as in Example 1 except that the ester compound A was replaced with the ester compound B. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 9.5% in an environment of 15° C./10%RH, which was on a good level, and was 14.6% in an environment of 7.5° C./10%RH. For the anti-offset properties, good results were obtained.

EXAMPLE 3

A magnetic fine black powder (a toner) with a volume average particle diameter of 6.48 μm was obtained using the same materials and following the same procedure as in Example 1 except that the ester compound A was replaced with the ester compound C. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 5.1% in an environment of 15° C./10%RH and 5.3% in an environment of 7.5° C./10%RH, which were on a good level. Good results were also obtained for the anti-offset properties.

EXAMPLE 4

A magnetic fine black powder (a toner) with a volume average particle diameter of 6.55 μm was obtained using the same materials and following the same procedure as in Example 1 except that the ester compound A was replaced with the ester compound D. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.6% in an environment of 15° C./10%RH and 10.5% in an environment of 7.5° C./10%RH, which were on a good level. Good results were also obtained for the anti-offset properties.

EXAMPLE 5

A magnetic fine black powder (a toner) with a volume average particle diameter of 6.57 μm was obtained using the same materials and following the same procedure as in Example 1 except that the ester compound A was replaced with the ester compound E. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 10.5% in an environment of 15° C./10%RH, which was on a good level, and was 17.2% in an environment of 7.5° C./10%RH. With regard to the anti-offset properties, good results were obtained.

EXAMPLE 6

A magnetic fine black powder (a toner) with a volume average particle diameter of 5.04 μm was obtained following the procedure of Example 1 but changing the conditions for the pulverization of the kneaded product of the toner materials and the classification of the pulverized product. To 100 parts by weight of the magnetic fine black powder thus obtained, 0.6 part by weight of negatively chargeable, hydrophobic dry-process colloidal silica (BET specific surface area: 300 $m^2/g$) was added like in Example 1, followed by mixing by means of a Henschel mixer to obtain a magnetic toner.

Using this magnetic toner as a one-component magnetic developer, evaluation was made in the same manner as in Example 1.

As the result, as is seen from Table 3, good images with a high image density were obtained at the initial stage and after of 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.4% in an environment of 15° C./10%RH and 9.4% in an environment of 7.5°

C./10%RH, which were on a good level. Good results were also obtained for the anti-offset properties.

The resolution, which is an evaluation standard for the image characteristics of copied images, was of 9.0 lines/mm even after 30,000 sheets copying, and as good and stable as the initial stage.

EXAMPLE 7

A magnetic fine black powder (a toner) with a volume average particle diameter of 10.5 μm was obtained following the procedure of Example 1 but changing the conditions for the pulverization of the kneaded product of the toner materials and the classification of the pulverized product. To 100 parts by weight of the magnetic fine black powder thus obtained, 0.6 part by weight of negatively chargeable, hydrophobic dry-process colloidal silica (BET specific surface area: 300 $m^2/g$) was added like in Example 1, followed by mixing by means of a Henschel mixer, obtaining a magnetic toner.

Using this magnetic toner as a one-component magnetic developer, evaluation was made in the same manner as in Example 1.

As the result, as is seen from Table 3, good images with a high image density were obtained at the initial stage and after of 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.6% in an environment of 15° C./10%RH and 9.8% in an environment of 7.5° C./10%RH, which were on a good level. Good results were also obtained for the anti-offset properties.

The resolution, which is an evaluation standard for the image characteristics of copied images, was of 5.6 lines/mm at the initial stage and 5.0 lines/mm after 30,000 sheet copying, and the level was slightly lower as compared with Example 1.

Comparative Example 1

A magnetic fine black powder (a toner) with a volume average particle diameter of 6.51 μm was obtained using the same materials and following the same procedure as in Example 1 except that the ester compound A was replaced with the ester compound F. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images with a high image density were obtained at the initial stage and after of 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 11.4% in an environment of 15° C./10%RH, but was 22.6% in an environment of 7.5° C./10%RH. As to the anti-offset properties, good results were obtained after 200 sheet copying in the environment of 15° C./10%RH, but image stain occurred after 500 sheet copying in the environment of 7.5° C./10%RH.

Comparative Example 2

A magnetic fine black powder (a toner) with a volume average particle diameter of 6.47 μm was obtained using the same materials and following the same procedure as in Example 1 except that the ester compound A was replaced with the ester compound G. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images with a high image density were obtained on both the initial images and the images of 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 12.6% in an environment of 15° C./10%RH, but was 24.1% in an environment of 7.5° C./10%RH. As to the anti-offset properties, good results were obtained after 200 sheet copying in the environment of 15° C./10%RH, but image stain occurred after 500 sheet copying in the environment of 7.5° C./10%RH.

Comparative Example 3

A magnetic fine black powder (a toner) with a volume average particle diameter of 6.28 μm was obtained using the same materials and following the same procedure as in Example 1 except that the ester compound A was replaced with the ester compound H. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images were obtained at the initial stage, but image density began to decrease with the progress of image reproduction and became 1.11 at 6,500 th sheet, and hence the copying test was stopped at the 6,500 th sheet. The charge quantity of the toner on the developing sleeve at 6,500 th sheet copying was −20.3 μC/g.

During the image reproducing operation, faulty cleaning occurred on copying about 6,400 th sheet and toner melt-adhesion to drum occurred on copying about 6,350 th sheet.

As to the fixing performance, the rate of decrease in image density was 20.7% in an environment of 15° C./10%RH, which was on a poor level. With regard to the anti-offset properties, image stain occurred because of web contamination.

Comparative Example 4

A magnetic fine black powder (a toner) with a volume average particle diameter of 6.17 μm was obtained using the same materials and following the same procedure as in Example 1 except that the ester compound A was replaced with the ester compound I. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images were obtained at the initial stage, but image density began to decrease with the progress of image reproduction and became 1.07 at 4,100 th sheet, and hence the copying test was stopped at 4,100 th sheet. The charge quantity of the toner on the developing sleeve at 4,100 th sheet copying was −21.1 μC/g.

During the image reproducing operation, faulty cleaning occurred on copying about 4,000 th sheet and toner melt-adhesion to drum occurred on copying about 4,050 th sheet.

As to the fixing performance, the rate of decrease in image density was 21.5% in an environment of 15° C./10%RH, which was on a poor level. With regard to the anti-offset properties, image stain occurred because of web contamination.

Comparative Example 5

A magnetic fine black powder (a toner) with a volume average particle diameter of 6.31 μm was obtained using the same materials and following the same procedure as in Example 1 except that the ester compound A was replaced with low-molecular weight polyethylene. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 3, good images were obtained at the initial stage, but image density began to decrease with the progress of image reproduction and became 1.12 at 3,000 th sheet, and hence the copying test was stopped at 3,000 th sheet. The charge quantity of the toner on the developing sleeve at 3,000th sheet copying was −23.1 μC/g.

During the image reproducing operation, faulty cleaning occurred on copying about 2,850 th sheet and toner melt-adhesion to drum occurred on copying about 2,900th sheet.

As to the fixing performance, the rate of decrease in image density was 23.4% in an environment of 15° C./10%RH, which was on a poor level. With regard to the anti-offset properties, image stain occurred because of web contamination.

The results of Examples 1 to 7 and Comparative Examples 1 to 5 are shown in Table 3.

TABLE 3(A)

| | Example | | | | | | |
|---|---|---|---|---|---|---|---|
| | 1 | 2 | 3 | 4 | 5 | 6 | 7 |
| Initial image density: | 1.28 | 1.29 | 1.28 | 1.28 | 1.29 | 1.28 | 1.29 |
| Image density after copying: | *1 1.31 | *1 1.30 | *1 1.30 | *1 1.31 | *1 1.31 | *1 1.31 | *1 1.30 |
| Initial charge quantity of toner on sleeve: (μC/g) | −15.1 | −14.8 | −14.4 | −14.7 | −14.5 | −15.1 | −14.8 |
| Charge quantity of toner on sleeve after copying: (μC/g) | *1 −15.3 | *1 −15.4 | *1 −15.2 | *1 −14.9 | *1 −15.0 | *1 −15.4 | −15.1 |
| Melt-adhesion of toner to drum: | No 30,000 sh copying | No 30,000 sh copying | No 30,000 sh copying | No 30,000 sh copying | No 30,000 sh copying | No 30,00 sh copying | No 30,000 sh copying |
| Faulty cleaning: | No 30,000 sh copying | No 30,000 sh copying | No 30,000 sh copying | No 30,000 sh copying | No 30,000 sh copying | No 30,00 sh copying | No 30,000 sh copying |
| Fixing performance (%): | | | | | | | |
| 15° C./10% RH: | 8.3 | 9.7 | 5.1 | 8.6 | 10.5 | 8.4 | 8.6 |
| 7.5° C./10% RH: | 8.7 | 14.6 | 5.3 | 10.2 | 17.2 | 9.4 | 9.8 |
| Anti-offset properties: | | | | | | | |
| 15° C./10% RH(1): | A | A | A | A | A | A | A |
| 7.5° C./10% RH(2): | A | A | A | A | A | A | A |

*1: Results on 30,000 sheet image reproducing operation
(1): After 200 sheet copying
(2): After 500 sheet copying

TABLE 3(B)

| | Comparative Example | | | | | Example |
|---|---|---|---|---|---|---|
| | 1 | 2 | 3 | 4 | 5 | 19 |
| Initial image density: | 1.28 | 1.30 | 1.25 | 1.25 | 1.24 | 1.25 |
| Image density after copying: | *1 1.32 | *1 1.31 | *2 1.11 | *3 1.07 | *4 1.12 | *1 1.26 |
| Initial charge quantity of toner on sleeve: (μC/g) | −14.6 | −15.2 | −16.1 | −16.4 | −16.4 | −17.4 |

TABLE 3(B)-continued

| | Comparative Example | | | | | Example |
|---|---|---|---|---|---|---|
| | 1 | 2 | 3 | 4 | 5 | 19 |
| Charge quantity of toner on sleeve after copying: | *1 | *1 | *2 | *3 | *4 | *1 |
| (μC/g) | −14.9 | −15.7 | −20.3 | −21.1 | −23.1 | −18.1 |
| Melt-adhesion of toner to drum: | No 30,000 sh copying | No 30,000 sh copying | Yes 6,350 sh copying | Yes 4,050 sh copying | Yes 2,900 sh copying | No 30,000 sh copying |
| Faulty cleaning: | No 30,000 sh copying | No 30,000 sh copying | Yes 6,400 sh copying | Yes 4,000 sh copying | Yes 2,850 sh copying | No 30,000 sh copying |
| Fixing performance (%): | | | | | | |
| 15° C./10% RH: | 11.4 | 12.6 | 20.7 | 21.5 | 23.4 | 3.5 |
| 7.5° C./10% RH: | 22.6 | 24.1 | 30.1 | 33.6 | 36.8 | 3.8 |
| Anti-offset properties: | | | | | | |
| 15° C./10% RH(1): | A | A | C | C | C | A |
| 7.5° C./10% RH(2): | C | C | C | C | C | A |

*1: Results on 30,000 sheet image reproducing operation
*2: Results on 6,500 sheet image reproducing operation
*3: Results on 4,100 sheet image reproducing operation
*4: Results on 3,000 sheet copying
(1): After 200 sheet copying
(2): After 500 sheet copying

EXAMPLE 8

A magnetic fine black powder (a toner) with a volume average particle diameter of 6.24 μm was obtained using the same materials and following the same procedure as in Example 1 except that the ester compound A was replaced with the ester compound J. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images with a high image density were obtained at the initial stage and after of 30,000 sheet copying. The charge quantity on the developing sleeve was also stable at the initial stage and after 30,000 sheet copying, without causing faulty cleaning and toner melt-adhesion to drum during the image reproducing copying. As to the fixing performance, the rate of decrease in image density was 8.4% in an environment of 15° C./10%RH and 9.1% in an environment of 7.5° C./10%RH, which were on a good level. Good results were also obtained for the anti-offset properties.

The resolution, which is an evaluation standard for the image characteristics of copied images, was of 8.0 lines/mm even after 30,000 sheets copying, and as good and stable as the initial stage.

EXAMPLE 9

A magnetic fine black powder (a toner) with a volume average particle diameter of 6.51 μm was obtained using the same materials and following the same procedure as in Example 1 except that the ester compound A was replaced with the ester compound K. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 9.9% in an environment of 15° C./10%RH, which was on a good level, but was 14.4% in an environment of 7.5° C./10%RH. With regard to the anti-offset properties, good results were obtained.

EXAMPLE 10

A magnetic fine black powder (a toner) with a volume average particle diameter of 6.37 μm was obtained using the same materials and following the same procedure as in Example 1 except that the ester compound A was replaced with the ester compound L. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 4.7% in an environment of 15° C./10%RH and 5.1% in an environment of 7.5° C./10%RH, which were on a good level. Good results were also obtained for the anti-offset properties.

EXAMPLE 11

A magnetic fine black powder (a toner) with a volume average particle diameter of 6.31 μm was obtained using the same materials and following the same procedure as in Example 1 except that the ester compound A was replaced with the ester compound M. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer to obtain a magnetic toner. Evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.8% in an environment of 15° C./10%RH, which was on a good level, and was 10.6% in an environment of 7.5° C./10%RH. With regard to the anti-offset properties, good results were obtained.

EXAMPLE 12

A magnetic fine black powder (a toner) with a volume average particle diameter of 6.45 μm was obtained using the same materials and following the same procedure as in Example 1 except that the ester compound A was replaced with the ester compound N. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 10.4% in an environment of 15° C./10%RH, which was on a good level, but was 17.7% in an environment of 7.5° C./10%RH. With regard to the anti-offset properties, good results were obtained.

EXAMPLE 13

A magnetic fine black powder (a toner) with a volume average particle diameter of 5.01 μm was obtained following the procedure of Example 1 but changing the conditions for the pulverization of the kneaded product of the toner materials and the classification of the pulverized product. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer to obtain a magnetic toner.

Using this magnetic toner as a one-component magnetic developer, evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.6% in an environment of 15° C./10%RH and 9.4% in an environment of 7.5° C./10%RH, which were on a good level. Good results were also obtained for the anti-offset properties.

The resolution, which is an evaluation standard for the image characteristics of copied images, was of 9.0 lines/mm even after 30,000 sheets copying, and as good and stable as the initial stage.

EXAMPLE 14

A magnetic fine black powder (a toner) with a volume average particle diameter of 10.7 μm was obtained following the procedure of Example 1 but changing the conditions for the pulverization of the kneaded product of the toner materials and the classification of the pulverized product. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner.

Using this magnetic toner as a one-component magnetic developer, evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.8% in an environment of 15° C./10%RH and 9.6% in an environment of 7.5° C./10%RH, which were on a good level. Good results were also obtained on the anti-offset properties.

The resolution, which is an evaluation standard for the image characteristics of copied images, was of 5.6 lines/mm at the initial stage and 5.6 lines/mm after 30,000 sheet copying, and the level is slightly lower as compared with Example 1.

Comparative Example 6

A magnetic fine black powder (a toner) with a volume average particle diameter of 6.47 μm was obtained using the same materials and following the same procedure as in Example 1 except that the ester compound A was replaced with the ester compound 0. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 11.6% in an environment of 15° C./10%RH, but was 22.9% in an environment of 7.5° C./10%RH. As to the anti-offset properties, good results were obtained after 200 sheet copying in the environment of 15° C./10%RH, but image stain occurred after 500 sheet copying in the environment of 7.5° C./10%RH.

Comparative Example 7

A magnetic fine black powder (a toner) with a volume average particle diameter of 6.38 μm was obtained using the same materials and following the same procedure as in Example 1 except that the ester compound A was replaced with the ester compound P. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 12.7% in an environment of 15° C./10%RH, but was 24.5% in an environment of 7.5° C./10%RH. As to the anti-offset properties, good results were obtained after 200 sheet copying in the environment of 15° C./10%RH, but image stain occurred after 500 sheet copying in the environment of 7.5° C./10%RH.

Comparative Example 8

A magnetic fine black powder (a toner) with a volume average particle diameter of 6.41 μm was obtained using the same materials and following the compound A was replaced with the ester compound Q. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images were obtained at the initial stage, but image density began to decrease with the progress of image reproduction and became 1.10 at 6,450th sheet, and hence the copying test was stopped at 6,450th sheet. The charge quantity of the toner on the developing sleeve at 6,450th sheet copying was −20.5 μC/g.

During the image reproducing operation, faulty cleaning occurred on copying about 6,380th sheet and toner melt-adhesion to drum occurred on copying about 6,400 th sheet.

As to the fixing performance, the rate of decrease in image density was 20.1% in an environment of 15° C./10%RH, which was on a poor level. With regard to the anti-offset properties, image stain occurred because of web contamination.

Comparative Example 9

A magnetic fine black powder (a toner) with a volume average particle diameter of 6.37 μm was obtained using the same materials and following the same procedure as in Example 1 except that the ester compound A was replaced with the ester compound R. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, as is seen from Table 4, good images were obtained at the initial stage, but image density began to decrease with the progress of image reproduction and became 1.09 at 4,000 th sheet, and hence the copying test was stopped at 4,000 th sheet. The charge quantity of the toner on the developing sleeve at 4,000 th sheet copying was −21.8 μC/g.

During the image reproducing copying, faulty cleaning occurred on copying about 3,900th sheet and toner melt-adhesion to drum occurred on copying about 3,930th sheet.

As to the fixing performance, the rate of decrease in image density was 21.7% in an environment of 15° C./10%RH, which was on a poor level. With regard to the anti-offset properties, image stain occurred because of web contamination.

The results of Examples 8 to 14 and Comparative Examples 6 to 9 are shown in Table 4 together with the results of Comparative Example 5.

TABLE 4(A)

| | Example | | | | | | |
|---|---|---|---|---|---|---|---|
| | 8 | 9 | 10 | 11 | 12 | 13 | 14 |
| Initial image density: | 1.29 | 1.30 | 1.28 | 1.29 | 1.30 | 1.28 | 1.29 |
| Image density after copying: | *1 1.31 | *1 1.30 | *1 1.31 | *1 1.30 | *1 1.30 | *1 1.31 | *1 1.30 |
| Initial charge quantity of toner on sleeve: (μC/g) | −14.8 | −14.9 | −14.7 | −15.1 | −14.8 | −14.8 | −14.7 |
| Charge quantity of toner on sleeve after copying: (μC/g) | *1 −15.2 | *1 −15.5 | *1 −15.1 | *1 −15.4 | *1 −15.3 | *1 −15.2 | *1 −15.5 |
| Melt-adhesion of toner to drum: | No 30,000 sh copying | No 30,000 sh copying | No 30,000 sh copying | No 30,000 sh copying | No 30,000 sh copying | No 30,00 sh copying | No 30,000 sh copying |
| Faulty cleaning: | No 30,000 sh copying | No 30,000 sh copying | No 30,000 sh copying | No 30,000 sh copying | No 30,000 sh copying | No 30,00 sh copying | No 30,000 sh copying |
| Fixing performance (%): | | | | | | | |
| 15° C./10% RH: | 8.4 | 9.9 | 4.7 | 8.8 | 10.4 | 8.6 | 8.8 |
| 7.5° C./10% RH: | 9.1 | 14.4 | 5.1 | 10.6 | 17.7 | 9.4 | 9.6 |

TABLE 4(A)-continued

| | Example | | | | | | |
|---|---|---|---|---|---|---|---|
| | 8 | 9 | 10 | 11 | 12 | 13 | 14 |
| Anti-offset properties: | | | | | | | |
| 15° C./10% RH: | A | A | A | A | A | A | A |
| 7.5° C./10% RH: | A | A | A | A | A | A | A |

*1: Results on 30,000 sheet image reproducing operation
(1): After 200 sheet copying
(2): After 500 sheet copying

TABLE 4(B)

| | Comparative Example | | | |
|---|---|---|---|---|
| | 6 | 7 | 8 | 9 |
| Initial image density: | 1.29 | 1.31 | 1.24 | 1.25 |
| Image density after copying: | *1 1.31 | *1 1.31 | *5 1.10 | *6 1.09 |
| Initial charge quantity of toner on sleeve: (μC/g) | −15.3 | −15.0 | −16.3 | −16.2 |
| Charge quantity of toner on sleeve after copying: (μC/g) | *1 −15.4 | *1 −15.2 | *5 −20.5 | *6 −21.8 |
| Melt-adhesion of toner to drum: | No 30,000 sh copying | No 30,000 sh copying | Yes 6,400 sh copying | Yes 3,930 sh copying |
| Faulty cleaning: | No 30,000 sh copying | No 30,000 sh copying | Yes 6,380 sh copying | Yes 3,900 sh copying |
| Fixing performance (%): | | | | |
| 15° C./10% RH: | 11.6 | 12.7 | 20.1 | 21.7 |
| 7.5° C./10% RH: | 25.9 | 24.5 | 30.4 | 34.1 |
| Anti-offset properties: | | | | |
| 15° C./10% RH: | A | A | C | C |
| 7.5° C./10% RH: | C | C | C | C |

*1: Results on 30,000 sheet image reproducing operation
*5: Results on 6,450 sheet image reproducing operation
*6: Results on 4,000 sheet image reproducing operation
(1): After 200 sheet copying
(2): After 500 sheet copying

| Example 15 | (by weight) |
|---|---|
| Polyester resin (polyester composed of bisphenol A, trimellitic acid, terephthalic acid and neopentyl glycol; Mw: 43,000) | 100 parts |
| Carbon black MOGAL (available from Cabot Corp.) | 3 parts |
| Negatively chargeable charge control agent | 1 part |
| Ester compound A | 3 parts |

The above materials were thoroughly mixed using a blender, and then melt-kneaded using a twin-screw extruder set at 110° C. The kneaded product obtained was cooled, and then granulated with a cutter mill. Thereafter the crushed product was finely pulverized by means of a pulberizer utilizing jet streams, and the finely pulverized product thus obtained was classified to obtain a non-magnetic fine black powder (a toner) with a volume average particle diameter of 6.39 μm. To 100 parts by weight of the fine black powder obtained, 0.6 part by weight of negatively chargeable, hydrophobic dry-process colloidal silica (BET specific surface area: 300 $m^2/g$) was added, followed by mixing by means of a Henschel mixer to give a toner. The toner thus obtained was blended with a fluorine resin-coated carrier (300/350 mesh) in a toner concentration of 5% to give a two-component developer.

This two-component developer was applied to a commercially available copying machine NP-5060 (process speed: 32.4 mm/sec), manufactured by Canon Inc., and images were reproduced under the environmental conditions of normal temperature and low humidity (23.5° C./5%RH). The test results of the image reproduction tested and evaluated in the same manner as in Example 1 are shown in Table 5. As is seen from Table 5, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.5% in an environment of 15° C./10%RH and 8.7% in an environment of 7.5° C./10%RH, which were on a good level. Good results were also obtained for the anti-offset properties.

The resolution, which is an evaluation standard for the image characteristics of copied images, was of 8.0 lines/mm even after 30,000 sheets copying, and as good and stable as the initial stage.

EXAMPLE 16

A non-magnetic fine black powder (a toner) with a volume average particle diameter of 6.47 μm was obtained using the same materials and following the same procedure as in Example 15 except that the ester compound A was replaced with the ester compound J. To 100 parts by weight of the fine black powder thus obtained, 0.6 part by weight of negatively chargeable, hydrophobic dry-process colloidal silica (BET specific surface area: 300 $m^2/g$) was added as in Example 15, followed by mixing by means of a Henschel mixer, obtaining a toner, which was then blended with the fluorine resin-coated carrier to give a two-component developer. Evaluation was made in the same manner as in Example 15.

As the result, as is seen from Table 5, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.6% in an environment of 15° C./10%RH and 8.9% in an environment of 7.5° C./10%RH, which were on a good level. Good results were also obtained for the anti-offset properties.

EXAMPLE 17

A non-magnetic fine black powder (a toner) with a volume average particle diameter of 5.03 μm was obtained following the procedure of Example 15 but changing the conditions for the pulverization of the kneaded product of the toner materials and the classification of the pulverized product. To 100 parts by weight of the fine black powder thus obtained, 0.6 part by weight of negatively chargeable, hydrophobic dry-process colloidal silica (BET specific surface area: 300 $m^2/g$) was added as in Example 15, followed by mixing by means of a Henschel mixer, obtaining a toner.

This toner was blended with the fluorine resin-coated carrier in the same manner as in Example 15 to give a two-component developer. Evaluation was also made in the same manner as in Example 15.

As the result, as is seen from Table 5, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.7% in an environment of 15° C./10%RH and 9.5% in an environment of 7.5° C./10%RH, which were on a good level. Good results were also obtained on the anti-offset properties.

The resolution, which is an evaluation standard for the image characteristics of copied images, was of 9.0 lines/mm even after 30,000 sheet copying, and as good and stable as the initial stage.

EXAMPLE 18

A non-magnetic fine black powder (a toner) with a volume average particle diameter of 10.3 μm was obtained following the procedure of Example 15 but changing the conditions for the pulverization of the kneaded product of the toner materials and the classification of the pulverized product. To 100 parts by weight of the fine black powder thus obtained, 0.6 part by weight of negatively chargeable, hydrophobic dry-process colloidal silica (BET specific surface area: 300 $m^2/g$) was added as in Example 15, followed by mixing by means of a Henschel mixer, obtaining a toner.

This toner was blended with the fluorine resin coated carrier in the same manner as in Example 15 to give a two-component developer. Evaluation was also made in the same manner as in Example 15.

As the result, as is seen from Table 5, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 8.6% in an environment of 15° C./10%RH and 9.7% in an environment of 7.5° C./10%RH, which were on a good level. Good results were also obtained for the anti-offset properties.

The resolution, which is an evaluation standard for the image characteristics of copied images, was of 5.6 lines/mm at the initial stage and 5.0 lines/mm after 30,000 sheet copying, and the level was slightly lower as compared with Example 1.

Comparative Example 10

A non-magnetic fine black powder (a toner) with a volume average particle diameter of 6.35 μm was obtained using the same materials and following the same procedure as in Example 15 except that the ester compound A was replaced with the ester compound F. To 100 parts by weight of the fine black powder thus obtained, 0.6 part by weight of negatively chargeable, hydrophobic dry-process colloidal silica (BET specific surface area: 300 $m^2/g$) was added as in Example 15, followed by mixing by means of a Henschel mixer, obtaining a toner, which was then blended with the fluorine resin-coated carrier to give a two-component developer. Evaluation was made in the same manner as in Example 15.

As the result, as is seen from Table 5, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 11.6% in an environment of 15° C./10%RH, but was 22.8% in an environment of 7.5° C./10%RH. With regard to the anti-offset properties, good results were obtained up to 200 sheets copying in an environment of 15° C./10%RH, bun in an environment of 7.5° C./10%RH, image stain occurred after 500 sheets copying.

Comparative Example 11

A non-magnetic fine black powder (a toner) with a volume average particle diameter of 6.31 μm was obtained using the same materials and following the same procedure as in Example 15 except that the ester compound A was replaced with the ester compound 0. To 100 parts by weight of the fine black powder thus obtained, 0.6 part by weight of negatively chargeable, hydrophobic dry-process colloidal silica (BET specific surface area: 300 $m^2/g$) was added as in Example 15, followed by mixing by means of a Henschel mixer, obtaining a toner, which was then blended with the fluorine resin-coated carrier to give a two-component developer. Evaluation was made in the same manner as in Example 15.

As the result, as is seen from Table 5, good images with a high image density were obtained at the initial stage and after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 11.5% in an environment of 15° C./10%RH, but was 23.0% in an environment of 7.5° C./10%RH. With regard to the anti-offset properties, good results were obtained up to 200 sheets copying in an environment of 15° C./10%RH, but in an environment of 7.5° C./10%RH, image stain occurred after 500 sheets copying.

Comparative Example 12

A non-magnetic fine black powder (a toner) with a volume average particle diameter of 6.41 μm was obtained using the same materials and following the same procedure as in Example 15 except that the ester compound A was replaced with low-molecular weight polyethylene. To 100 parts by weight of the fine black powder thus obtained, 0.6 part by weight of negatively chargeable, hydrophobic dry-process colloidal silica (BET specific surface area: 300 $m^2/g$) was added as in Example 15, followed by mixing by means of a Henschel mixer, obtaining a toner, which was then blended with the fluorine resin-coated carrier to give a two-component developer. Evaluation was made in the same manner as in Example 15.

As the result, as is seen from Table 5, good images were obtained at the initial stage, but image density began to decrease with the progress of image reproduction and became 1.10 at 3,000th sheet, and hence the copying test was stopped at 3,000th sheet. The charge quantity of the toner on the developing sleeve at 3,000th sheet copying was −23.5 μC/g.

During the image reproducing operation, faulty cleaning occurred on copying about 2,650th sheet and toner melt-adhesion to drum occurred on copying 2,700th sheet.

As to the fixing performance, the rate of decrease in image density was 23.7% in an environment of 15° C./10%RH, which was on a poor level. With regard to the anti-offset properties, image stain occurred because of web contamination.

| | (by weight) |
|---|---|
| Compound A | 3,234 parts |
| 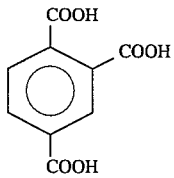 | 210 parts |

The above compounds were reacted in the presence of monobutyltin oxide, and the reaction product was taken out after a reaction time of 150 minutes. This product was designated as ester compound S.

TABLE 5

| | Example | | | | Comparative Example | | | Example |
|---|---|---|---|---|---|---|---|---|
| | 15 | 16 | 17 | 18 | 10 | 11 | 12 | 20 |
| Initial image density: | 1.30 | 1.30 | 1.28 | 1.31 | 1.28– | 1.30 | 1.25 | 1.25 |
| Image density after copying: | *1 1.32 | *1 1.30 | *1 1.31 | *1 1.31 | *1 1.31 | *1 1.31 | *7 1.10 | *1 1.25 |
| Initial charge quantity of toner on sleeve: (μC/g) | −14.7 | −14.8 | −14.6 | −15.0 | −14.5 | −14.6 | −16.7 | −17.1 |
| Charge quantity of toner on sleeve after copying: (μC/g) | *1 −15.3 | *1 −15.2 | *1 −15.1 | *1 −15.2 | *1 −15.4 | *1 −15.1 | *7 −23.5 | *1 −17.7 |
| Melt-adhesion of toner to drum: | No 30,000 sh copying | No 30,000 sh copying | No 30,000 sh copying | No 30,000 sh copying | No 30,000 sh copying | No 30,000 sh copying | Yes 2,700 sh copying | No 30,000 sh copying |
| Faulty cleaning: | No 30,000 sh copying | No 30,000 sh copying | No 30,000 sh copying | No 30,000 sh copying | No 30,000 sh copying | No 30,000 sh copying | Yes 2,650 sh copying | No 30,000 sh copying |
| Fixing performance (%): | | | | | | | | |
| 15° C./10% RH: | 8.5 | 8.6 | 8.7 | 8.6 | 11.6 | 11.5 | 23.7 | 3.6 |
| 7.5° C./10 %RH: | 8.7 | 8.9 | 9.5 | 9.7 | 22.8 | 23.0 | 37.1 | 3.7 |
| Anti-offset properties: | | | | | | | | |
| 15° C./10% RH(1): | A | A | A | A | A | A | C | A |
| 7.5° C./10% RH(2): | A | A | A | A | C | C | C | A |

*1: Results on 30,000 sheet image reproduct operation
*7: Results on 3,000 sheet image reproducing operation
(1): After 200 sheet copying
(2): After 500 sheet copying

| Production Example 19 | (by weight) |
|---|---|
| $CH_3(CH_2CH_2)_{27}OH$ | 788 parts |
| Propylene oxide | 290 parts |

The above compounds were reacted in the presence of sodium ethoxide under the conditions of a pressure of $1.72\times10^5$ Pa and a temperature of 140° C., and the reaction product was taken out after a reaction time of 20 minutes. This product was designated as compound A. The compound had the following structure.

Mn (number average molecular weight) and Mw (weight average molecular weight) of the ester compound S as measured by GPC were Mn: 3,189 and Mw: 3,381, respectively.

The compound A, the monohydroxylic compound used in this reaction, had an alkylene group with 54 carbon atoms in its long-chain alkyl group, and a number average molecular weight (Mn) of 1,083 and a weight average molecular weight (Mw) of 1,148, and the carboxylic acid had a molecular weight of 210.

EXAMPLE 19

A magnetic fine black powder (a toner) with a volume average particle diameter of 6.54 μm was obtained using the same materials and following the same procedure as in Example 1 except that the ester compound A was replaced with the ester compound S. To 100 parts by weight of the magnetic fine black powder thus obtained, 0.6 part by weight of negatively chargeable, hydrophobic dry-process colloidal silica (BET specific surface area: 300 $m^2/g$) was added as in Example 1, followed by mixing by means of a Henschel mixer, obtaining a magnetic toner. Evaluation was made in the same manner as in Example 1.

As the result, the image density was stable at the initial stage and also after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 3.5% in an environment of 15° C./10%RH and 3.8% in an environment of 7.5° C./10%RH, which were on a good level. Good results were also obtained on the anti-offset properties.

The results of evaluation are shown together in Table 3 showing the results for evaluation in Example 1.

EXAMPLE 20

A non-magnetic fine black powder (a toner) with a volume average particle diameter of 6.54 μm was obtained using the same materials and following the same procedure as in Example 15 except that the ester compound A was replaced with the ester compound S. To 100 parts by weight of the fine black powder thus obtained, 0.6 part by weight of negatively chargeable, hydrophobic dry-process colloidal silica (BET specific surface area: 300 $m^2/g$) was added as in Example 15, followed by mixing by means of a Henschel mixer, obtaining a toner, which was then blended with the fluorine resin-coated carrier to give a two-component developer. Evaluation was made in the same manner as in Example 15.

As the result, the image density was stable at the initial stage and also after 30,000 sheet copying. The charge quantity on the developing sleeve was also stable at the initial stage and after 30,000 sheet copying, without causing faulty cleaning and toner melt-adhesion to drum during the image reproducing operation. As to the fixing performance, the rate of decrease in image density was 3.6% in an environment of 15° C./10%RH and 3.7% in an environment of 7.5° C./10%RH, which were on a good level. Good results were also obtained for the anti-offset properties.

The results of evaluation are shown together in Table 5 showing the results for evaluation in Example 15.

What is claimed is:

1. A toner for developing electrostatic images, comprising:

(i) a binder resin;

(ii) a colorant; and (iii) a compound made by a reaction of a monohydroxylic compound having a long-chain alkyl group having an alkylene group with 40 or more carbon atoms and a hydroxyl group with a carboxylic acid having a molecular weight of 1,000 or less, said carboxylic acid being selected from the group consisting of formic acid, acetic acid, propionic acid, lactic acid, isolactic acid, valeric acid, pivalic acid, lauric acid, myristic acid, palmitic acid, stearic acid, acrylic acid, propionic acid, methacrylic acid, crotonic acid, oleic acid, furoic acid, nicotinic acid, isonicotinic acid, fumaric acid, maleic acid, citraconic acid, itaconic acid, succinic acid, adipic acid, sebacic acid, azelaic acid, benzoic acid, toluic acid, naphthoic acid, cinnamic acid, phthalic acid, terephthalic acid, trimellitic acid, pyromellitic acid, and acid anhydrides thereof, or a compound made by a reaction of a monocarboxylic compound having a long-chain alkyl group having an alkylene group with 40 or more carbon atoms and a carboxyl group with an alcohol having a molecular weight of 1,000 or less, said alcohol being selected from the group consisting of methyl alcohol, ethyl alcohol, propyl alcohol, isopropyl alcohol, butyl alcohol, isobutyl alcohol, sec-butyl alcohol, tert-butyl alcohol, n-amyl alcohol, isoamyl alcohol, hexyl alcohol, heptyl alcohol, octyl alcohol, capryl alcohol, allyl alcohol, crotyl alcohol, propargyl alcohol, cyclopentanol, cyclohexanol, benzyl alcohol, cinnamyl alcohol, furfuryl alcohol, ethylene glycol, propylene glycol, 1, 3-butanediol, 1,4-butanediol, 2,3-butanediol, diethylene glycol, dipropylene glycol, triethylene glycol, 1,5-pentanediol, 1,6-hexanediol, neopentyl glycol, pentaerythritol diallyl ether, trimethylene glycol, 2-ethyl-1, 3-hexanediol, hydrogenated bisphenol A and a bisphenol derivative represented by the formula:

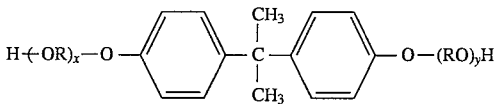

wherein R is an ethylene group or a propylene group and x and y are each an integer of 1 or more, and total 2 to 10.

2. The toner according to claim 1, wherein the alkylene group has carbon atoms of from 40 to 200.

3. The toner according to claim 1, wherein the alkylene group has carbon atoms of from 50 to 150.

4. The toner according to claim 1, wherein the monohydroxylic compound has a number average molecular weight (Mn) of 592 or more.

5. The toner according to claim 1, wherein the monohydroxylic compound has a number average molecular weight (Mn) of from 592 to 2,832.

6. The toner according to claim 1, wherein the monocarboxylic compound has a number average molecular weight (Mn) of 620 or more.

7. The toner according to claim 1, wherein the monocarboxylic compound has a number average molecular weight (Mn) of from 620 to 2,860.

8. The toner according to claim 1, wherein the compound made by the reaction of the monohydroxylic compound with the carboxylic acid has a number average molecular weight (Mn) of 1,550 or more, and a weight average molecular weight (Mw) of 1,550 or more.

9. The toner according to claim 1, wherein the compound made by the reaction of the monohydroxylic compound with the carboxylic acid has a number average molecular weight (Mn) of from 1,550 to 7,000 or more, and a weight average molecular weight (Mw) of from 1,550 to 7,000.

10. The toner according to claim 1, wherein the compound made by the reaction of the monocarboxylic compound with the alcohol has a number average molecular weight (Mn) of 1,550 or more, and a weight average molecular weight (Mw) of 1,550 or more.

11. The toner according to claim 1, wherein the compound made by the reaction of the monocarboxylic compound with the alcohol has a number average molecular weight (Mn) of from 1,550 to 7,000 or more, and a weight average molecular weight (Mw) of from 1,550 to 7,000.

12. The toner according to claim 1, wherein the compound made by the reaction of the monohydroxylic compound with the carboxylic acid is contained in the toner in an amount of from 1% to 20% by weight based on 100% by weight of the binder resin.

13. The toner according to claim 1, wherein the compound made by the reaction of the monohydroxylic compound with the carboxylic acid is contained in the toner in an amount of from 2% to 15% by weight based on 100% by weight of the binder resin.

14. The toner according to claim 1, wherein the compound made by the reaction of the monocarboxylic compound with the alcohol is contained in the toner in an amount of from 1% to 20% by weight based on 100% by weight of the binder resin.

15. The toner according to claim 1, wherein the compound made by the reaction of the monocarboxylic compound with the alcohol is contained in the toner in an amount of from 2% to 15% by weight based on 100% by weight of the binder resin.

16. The toner according to claim 1, wherein the monohydroxylic compound is selected from the compounds represented by the following formulas (I) to (IV):

$$CH_3(CH_2CH_2)_lOH\ (l \geqq 20) \quad \text{(I)}$$

$$CH_3(CH_2CH_2)_m\underset{\underset{OH}{|}}{CH}-R\ (m \geqq 20;\ R \text{ is H or } C_1\text{–}C_{20} \text{ alkyl}) \quad \text{(II)}$$

$$CH_3(CH_2)_nOH\ (n \geqq 40) \quad \text{(III)}$$

$$CH_3(CH_2)_o\underset{\underset{OH}{|}}{CH}-R'\ (o \geqq 40;\ R' \text{ is H or } C_1\text{–}C_{20} \text{ alkyl}). \quad \text{(IV)}$$

17. The toner according to claim 1, wherein the monohydroxylic compound is a reaction product of a long-chain alkyl alcohol with a compound having an epoxy group in a molecule.

18. The toner according to claim 17, wherein the monohydroxylic compound is represented by the following formula:

$$CH_3(CH_2)_n-O\left[\underset{\underset{R''}{|}}{CH}-CH_2-O\right]_pH \quad \text{(VII)}$$

wherein n represents a number of 40 or more, p represents a number of from 1 to 10, and R" represents a hydrogen atom, a hydrocarbon group with carbon atoms of from 1 to 20 or $R_4$—$CH_2$— where $R_4$ represents an ether group or an ester group.

19. The toner according to claim 1, wherein the monohydroxylic compound is selected from the compounds represented by the following formulas (I) to (IV):

$$CH_3(CH_2CH_2)_qCOOH\ (q \geqq 20) \quad \text{(VIII)}$$

$$CH_3(CH_2CH_2)_r\underset{\underset{COOH}{|}}{CH}-R'''\ (r \geqq 20;\ R''' \text{ is H or } C_1\text{–}C_{20} \text{ alkyl}) \quad \text{(IX)}$$

$$CH_3(CH_2)_sCOOH\ (s \geqq 40) \quad \text{(III)}$$

$$CH_3(CH_2)_t\underset{\underset{COOH}{|}}{CH}-R''''\ (t \geqq 40:\ R'''' \text{ is H or } C_1\text{–}C_{20} \text{ alkyl}). \quad \text{(IV)}$$

20. The toner according to claim 1, wherein the carboxylic acid is a polycarboxylic acid.

21. The toner according to claim 1, wherein the carboxylic acid has a molecular weight of from 50 to 1,000.

22. The toner according to claim 1, wherein the carboxylic acid has a molecular weight of from 100 to 1,000.

23. The toner according to claim 1, wherein the alcohol is a polyhydric alcohol.

24. The toner according to claim 1, wherein the alcohol has a molecular weight of from 50 to 1,000.

25. The toner according to claim 1, wherein the alcohol has a molecular weight of from 100 to 1,000.

26. The toner according to claim 1, wherein the binder resin has a polyester resin.

27. The toner according to claim 1, wherein the binder resin has a styrene-acryl resin.

28. The toner according to claim 1, wherein the colorant comprises a magnetic material.

29. The toner according to claim 28, wherein the magnetic toner constitutes a magnetic one-component developer.

30. The toner according to claim 1, wherein the toner comprises a pigment or a dye.

31. The toner according to claim 30, wherein the color toner constitutes a non-magnetic one-component developer.

32. The toner according to claim 30, wherein the color toner is mixed with a carrier to constitute a two-component developer.

33. The toner according to claim 1, wherein the toner comprises toner particles and silica fine powder.

34. The toner according to claim 1, wherein the toner comprises particles with a volume average particle diameter of from 3 to 8 μm.

35. The toner according to claim 1, wherein the toner is a heat fixing toner.

36. An image forming method comprising:

forming an electrostatic latent image on an electrostatic latent image bearing member;

developing the electrostatic latent image through a developing means in a developing zone to form a toner image on the electrostatic latent image bearing member;

wherein the developing means holds a toner, the toner comprising:

(i) a binder resin;

(ii) a colorant; and (iii) a compound made by a reaction of a monohydroxylic compound having a long-chain alkyl group having an alkylene group with 40 or more carbon atoms and a hydroxyl group with a carboxylic acid having a molecular weight of 1,000 or less, said carboxylic acid being selected from the group consisting of formic acid, acetic acid, propionic acid, lactic acid, isolactic acid, valeric acid, pivalic acid, lauric acid, myristic acid, palmitic acid, stearic acid, acrylic acid, propionic acid, methacrylic acid, crotonic acid, oleic acid, furoic acid, nicotinic acid, isonicotinic acid, fumaric acid, maleic acid, citraconic acid, itaconic acid, succinic acid, adipic acid, sebacic acid, azelaic acid, benzoic acid, toluic acid, naphthoic acid, cinnamic acid, phthalic acid, terephthalic acid, trimellitic acid, pyromellitic acid, and acid anhydrides thereof, or a compound made by a reaction of a monocarboxylic compound having a long-chain alkyl group having an alkylene group with 40 or more carbon atoms and a carboxyl group with an alcohol having a molecular weight of 1,000 or less, said alcohol being selected from the group consisting of methyl alcohol, ethyl alcohol, propyl alcohol, isopropyl alcohol, butyl alcohol, isobutyl alcohol, sec-butyl alcohol, tert-butyl alcohol, n-amyl alcohol, isoamyl alcohol, hexyl alcohol, heptyl alcohol, octyl alcohol, capryl alcohol, allyl alcohol, crotyl alcohol, propargyl alcohol, cyclopentanol, cyclohexanol, benzyl alcohol, cinnamyl alcohol, furfuryl alcohol, ethylene glycol, propylene glycol, 1,3-butanediol, 1,4-butanediol, 2,3-butanediol, diethylene glycol, dipropylene glycol, triethylene glycol, 1,5-pentanediol, 1,6-hexanediol, neopentyl glycol, pentaerythritol diallyl ether, trimethylene glycol, 2-ethyl-1, 3-hexanediol, hydrogenated bisphenol A and a bisphenol derivative represented by the formula.

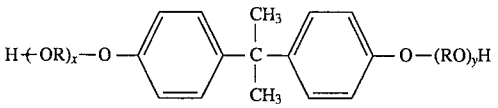

wherein r is an ethylene group or a propylene group and x and y are each an integer of 1 or more, and total 2 to 10;

transferring the toner image to a recording medium; and fixing the transferred toner image to the recording medium.

37. The method according to claim 36, which is carried out at a process speed of 380 mm/sec or more.

38. A process cartridge which is detachable from the body of an image forming apparatus, comprising:

an electrostatic latent image bearing member and a developing means; wherein the developing means holds a toner, the toner comprising;

(i) a binder resin;

(ii) a colorant; and (iii) a compound made by a reaction of a monohydroxylic compound having a long-chain alkyl group having an alkylene group with 40 or more carbon atoms and a hydroxyl group with a carboxylic acid having a molecular weight of 1,000 or less, said carboxylic acid being selected from the group consisting of formic acid, acetic acid, propionic acid, lactic acid, isolactic acid, valeric acid, pivalic acid, lauric acid, myristic acid, palmitic acid, stearic acid, acrylic acid, propionic acid, methacrylic acid, crotonic acid, oleic acid, furoic acid, nicotinic acid, isonicotinic acid, fumaric acid, maleic acid, citraconic acid, itaconic acid, succinic acid, adipic acid, sebacic acid, azelaic acid, benzoic acid, toluic acid, naphthoic acid, cinnamic acid, phthalic acid, terephthalic acid, trimellitic acid, pyromellitic acid, and acid anhydrides thereof, or a compound made by a reaction of a monocarboxylic compound having a long-chain alkyl group having an alkylene group with 40 or more carbon atoms and a carboxyl group with an alcohol having a molecular weight of 1,000 or less, said alcohol being selected from the group consisting of methyl alcohol, ethyl alcohol, propyl alcohol, isopropyl alcohol, butyl alcohol, isobutyl alcohol, sec-butyl alcohol, tert-butyl alcohol, n-amyl alcohol, isoamyl alcohol, hexyl alcohol, heptyl alcohol, octyl alcohol, capryl alcohol, allyl alcohol, crotyl alcohol, propargyl alcohol, cyclopentanol, cyclohexanol, benzyl alcohol, cinnamyl alcohol, furfuryl alcohol, ethylene glycol, propylene glycol, 1,3-butanediol, 1,4-butanediol, 2,3-butanediol, diethylene glycol, dipropylene glycol, triethylene glycol, 1,5-pentanediol, 1,6-hexanediol, neopentyl glycol, pentaerythritol diallyl ether, trimethylene glycol, 2-ethyl-1,3-hexanediol, hydrogenated bisphenol A, and a bisphenol derivative represented by the formula:

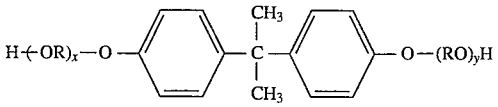

wherein R is an ethylene group or a propylene group and x and y are each an integer of 1 or more, and total 2 to 10.

39. The process cartridge according to claim 38, wherein, in addition to the developing means and an electrophotographic photosensitive member as the electrostatic latent image bearing member, at least one of a charging means and a cleaning means is provided, and the developing means, the electrostatic latent image bearing member and at least one of the charging means and the cleaning means are integrally joined as one cartridge which is detachable from the body of the image forming apparatus.

40. The method according to claim 36, wherein the toner is any one of the toners of claims 2–35.

41. The process cartridge according to claim 38, wherein the toner is any one of the toners of claims 2–35.

* * * * *

UNITED STATES PATENT AND TRADEMARK OFFICE

CERTIFICATE OF CORRECTION

PATENT NO. : 5,604,072

DATED : February 18, 1997

INVENTOR(S) : MAKOTO UNNO ET AL.

It is certified that error appears in the above-identified patent and that said Letters Patent is hereby corrected as shown below:

AT [56] REFERENCES CITED

Other Publications,
"Abstract" should read --Abstracts--.

COLUMN 1

Line 20, "an" should be deleted.
Line 43, "given" should read --give--.

COLUMN 2

Line 2, "a" should be deleted.
Line 27, "not a" should read --a--.

COLUMN 3

Line 29, "store" should read --stored--.
Line 39, "comprising;" should read --comprising:--.
Line 53, "comprising;" should read --comprising:--.
Line 59, "comprising;" should read --comprising:--.

COLUMN 4

Line 10, "comprising;" should read --comprising:--.
Line 13, "comprising;" should read --comprising:--.
Line 42, "$\beta$")," should read --$\alpha$"),--.
Line 48, "its" should read --their--.

UNITED STATES PATENT AND TRADEMARK OFFICE

CERTIFICATE OF CORRECTION

PATENT NO. : 5,604,072

DATED : February 18, 1997

INVENTOR(S) : MAKOTO UNNO ET AL.

It is certified that error appears in the above-identified patent and that said Letters Patent is hereby corrected as shown below:

COLUMN 5

Line 26, "value" should read --a value--.
Line 55, "prevent;" should read --prevent:--.
Line 59, "which" should read --¶ which--.

COLUMN 6

Line 18, "occurs;" should read --occurs:--.
Line 19, "rublicity" should read --lubricity--.

COLUMN 7

Line 26, "(alkylalluminum)" should read --(alkylaluminum)--.

COLUMN 9

Line 42, "furoric" should read --furoic--.
Line 46, "sebasic" should read --sebacic--.

COLUMN 10

Line 21, "i" should read --l--.
Line 54, "suspended," should read --suspended--.

COLUMN 11

Line 47, "a-methylene" should read --α-methylene--.

UNITED STATES PATENT AND TRADEMARK OFFICE

CERTIFICATE OF CORRECTION

PATENT NO. : 5,604,072

DATED : February 18, 1997

INVENTOR(S) : MAKOTO UNNO ET AL.

It is certified that error appears in the above-identified patent and that said Letters Patent is hereby corrected as shown below:

COLUMN 12

Line 66, "Hanza" should read --Hansa--.
Line 67, "Indanethrene" should read --Indanthrene--.

COLUMN 14

Line 48, "is" should read --are--.

COLUMN 20

Line 64, "compound 0." should read --compound O.--.

COLUMN 24

Line 66, "an" should be deleted.

COLUMN 25

Line 3, "an" should be deleted.

COLUMN 26

Line 61, "of" should be deleted.

COLUMN 27

Line 26, "of" should be deleted.
Line 57, "of" should be deleted.

UNITED STATES PATENT AND TRADEMARK OFFICE

CERTIFICATE OF CORRECTION

PATENT NO. : 5,604,072

DATED : February 18, 1997

INVENTOR(S) : MAKOTO UNNO ET AL.

It is certified that error appears in the above-identified patent and that said Letters Patent is hereby corrected as shown below:

COLUMN 31

Line 41, "of" should be deleted.

COLUMN 34

Line 49, "compound 0." should read --compound O.--.

COLUMN 35

Line 34, "the compound A" should read --the same procedure as in Example 1 except that the ester compound A--.

COLUMN 36

Line 45, "together with the results of Comparative Example 5." should be deleted.

COLUMN 37

Line 60, "pulberizer" should read --pulverizer--.

COLUMN 39

Line 43, "resin coated" should read --resin-coated--.

COLUMN 40

Line 23, "bun" should read --but--.
Line 33, "compound 0." should read --compound O.--.

UNITED STATES PATENT AND TRADEMARK OFFICE

CERTIFICATE OF CORRECTION

PATENT NO. : 5,604,072

DATED : February 18, 1997

INVENTOR(S) : MAKOTO UNNO ET AL.

It is certified that error appears in the above-identified patent and that said Letters Patent is hereby corrected as shown below:

COLUMN 45

Line 45, "formulas (I) to (IV):" should read --formulas (VIII) to (XI):--.
Line 53, "(III)" should read --(X)--.
Line 54, "(IV)" should read --(XI)--.

COLUMN 46

Line 10, "color toner" should read --toner--.
Line 12, "color toner" should read --toner--.

COLUMN 47

Line 2, "formula." should read --formula:--.
Line 18, "wherein" should read --¶ wherein--.
Line 19, "comprising;" should read --comprising:--.

Signed and Sealed this

Seventh Day of October, 1997

*Attest:*

*Attesting Officer*

BRUCE LEHMAN

*Commissioner of Patents and Trademarks*